US007429821B2

(12) United States Patent
Ando

(10) Patent No.: US 7,429,821 B2
(45) Date of Patent: Sep. 30, 2008

(54) IMAGE DISPLAY APPARATUS

(75) Inventor: Yoichi Ando, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 528 days.

(21) Appl. No.: 11/139,488

(22) Filed: May 31, 2005

(65) Prior Publication Data

US 2005/0264166 A1 Dec. 1, 2005

(30) Foreign Application Priority Data

Jun. 1, 2004 (JP) ..... 2004-163003

(51) Int. Cl.
*H01J 1/62* (2006.01)
*H01J 63/04* (2006.01)

(52) U.S. Cl. ..... 313/495; 313/496; 313/497

(58) Field of Classification Search ..... 313/495–497
See application file for complete search history.

(56) References Cited

U.S. PATENT DOCUMENTS

| | | | | |
|---|---|---|---|---|
| 5,760,538 | A | 6/1998 | Mitsutake et al. | 313/422 |
| 6,053,791 | A | 4/2000 | Fujii et al. | 445/6 |
| 6,140,985 | A * | 10/2000 | Kanai et al. | 345/74.1 |
| 6,184,619 | B1 | 2/2001 | Yamazaki et al. | 313/495 |
| 6,274,972 | B1 | 8/2001 | Mitsutake et al. | 313/292 |
| 6,441,544 | B1 | 8/2002 | Ando et al. | 313/310 |
| 6,534,911 | B1 | 3/2003 | Ando | 313/496 |
| 6,759,802 | B2 | 7/2004 | Ando | 313/495 |
| 6,802,753 | B1 | 10/2004 | Ando et al. | 445/6 |
| 6,878,028 | B1 | 4/2005 | Fujii et al. | 445/6 |
| 6,884,138 | B1 | 4/2005 | Ando et al. | 445/24 |
| 6,946,786 | B2 | 9/2005 | Ando | 313/496 |
| 6,984,160 | B2 | 1/2006 | Ando et al. | 445/24 |
| 7,005,797 | B2 | 2/2006 | Ando | 313/495 |
| 7,053,537 | B2 | 5/2006 | Hiroike et al. | 313/292 |
| 7,075,223 | B2 | 7/2006 | Ando | 313/495 |
| 2002/0171608 | A1 * | 11/2002 | Kanai et al. | 345/55 |
| 2003/0164675 | A1 | 9/2003 | Ando | 313/495 |
| 2004/0227453 | A1 | 11/2004 | Ando et al. | 313/495 |
| 2005/0162065 | A1 | 7/2005 | Kojima et al. | 313/495 |
| 2005/0285503 | A1 | 12/2005 | Ando | 313/495 |
| 2006/0049744 | A1 | 3/2006 | Ando | 313/496 |

FOREIGN PATENT DOCUMENTS

| | | |
|---|---|---|
| EP | 0 690 472 A1 | 1/1996 |
| EP | 0 869 530 A2 | 10/1998 |
| JP | 8-7809 | 1/1996 |
| JP | 8-180821 | 7/1996 |
| JP | 10-301527 | 11/1998 |
| JP | 10-334834 | 12/1998 |

* cited by examiner

*Primary Examiner*—Nimeshkumar D. Patel
*Assistant Examiner*—Thomas A Hollweg
(74) *Attorney, Agent, or Firm*—Fitzpatrick, Cella, Harper & Scinto

(57) ABSTRACT

An irregular shift of the electron beam caused by a spacer is compensated without making a design change of the spacer. A rear plate 1 in which an electron source substrate 9 disposed with plural electron-emitting devices 8 emitting the electron is fixed and a face plate 2 in which a metal back 11 for accelerating the electron is formed are disposed in opposition to each other, and these plates are supported by the spacers 3 with constant intervals, and the initial velocity vector of the electron emitted from the electron-emitting device 8 is different according to the distance from the spacer 3.

7 Claims, 15 Drawing Sheets

IMAGE DISPLAY APPARATUS

BACKGROUND OF THE INVENTION

1. Field of the Invention

The present invention relates to an image display apparatus, and in particular, it relates to an image display apparatus, comprising a first substrate on which a plurality of electron-emitting devices and wirings for driving these devices are formed, and a second substrate, disposed in opposition to this first substrate, on which electrodes regulated to potential higher than the wirings are formed, and spacers for supporting these substrates at constant intervals.

2. Related Background Art

In general, in an image display apparatus, spacers composed of insulating material are nipped between the first substrate which is an electron source side and the second substrate which is a display surface side, thereby obtaining a required resistance to atmosphere. In the case of such a constitution, when the spacer is charged, it affects the trajectory of the electron emitted from the electron-emitting device positioned in the vicinity of the spacer, and causes a shift in the emitting-position in the display surface. This causes an image deterioration, for example, such as a lowering of emission luminance of the pixel in the vicinity of the spacer, a color blur, and the like.

Heretofore, for the charge prevention of the spacer, it has been known to use the spacer coated with a high resistance film. For example, in Japanese Patent Application Laid-Open No. H08-180821 (EP690472A), there has been proposed a plate-shaped spacer coated with a high resistance film which is nipped along the wiring of the first substrate such that the high resistance film is electrically connected to this wiring and the electrode of the second substrate. Further, in Patent Document 1, there has been proposed that spacer electrodes are provided up and down the spacer coated with the high resistance film, so that the high resistance film contacts the wiring and the electrodes through the spacer electrode.

In addition to the above, in Japanese Patent Laid-Open Publication No. H10-334834 (EP869530A), there has been proposed that the abutting portions of the first substrate side and the second substrate side of the spacer coated with the high resistance film are provided with a conductive intermediate layer (spacer electrode), respectively, and this is operated as an electrode for controlling the trajectory of electron beam.

However, as a result of strenuous investigations by the present inventor, even in the display apparatus comprising a spacer provided with a high resistance film and a spacer electrode, due to installation state and driving condition of the spacer, and the like, the trajectory of electron emitted from electron-emission device is different in the peripheral portion of the spacer and the portion other than that portion, and as a result, there has been a problem brought about that a display image is distorted. An object of the present invention is to solve this problem and provide an image display apparatus which can display an excellent image.

SUMMARY OF THE INVENTION

To achieve the above described object, the image display apparatus of the present invention comprises:

an electron source having a plurality of electron-emitting devices comprising a pair of device electrodes disposed in opposition to each other with a gap in between;

an electron-emitting region positioned between the pair of device electrodes;

an electrode positioned in opposition to the electron source; and a spacer positioned being between the electron source and the electrode, and positioned adjacent to some electron-emitting devices among the plurality of electron-emitting devices, wherein a longitudinal direction of the gap between the pair of device electrodes of at least of one of the electron-emitting device adjacent to the spacer is different from the longitudinal direction of the gap between the pair of device electrodes of the electron-emitting device not adjacent to the spacer.

According to the image display apparatus, with the constitution of the spacer itself remained as it is, through the control of the initial velocity vector of the electron-emitting device, a desired electron beam incident position is attained. Specifically, by setting the emitting direction of the electron emitted from the electron-emitting device, more preferably the emitting velocity, according to the distance (degree of the effect from the spacer) from the spacer, the irregular shift of the electron beam caused by the spacer is compensated. Hence, the electron beam trajectory can be set according to the design, and there is no more need of highly accurate installation of the spacer nor is there any need of design change.

DETAILED DESCRIPTION OF THE PREFERRED EMBODIMENTS

Next, embodiments of the present invention will be described with reference to the drawings.

First Embodiment

Figure 1:
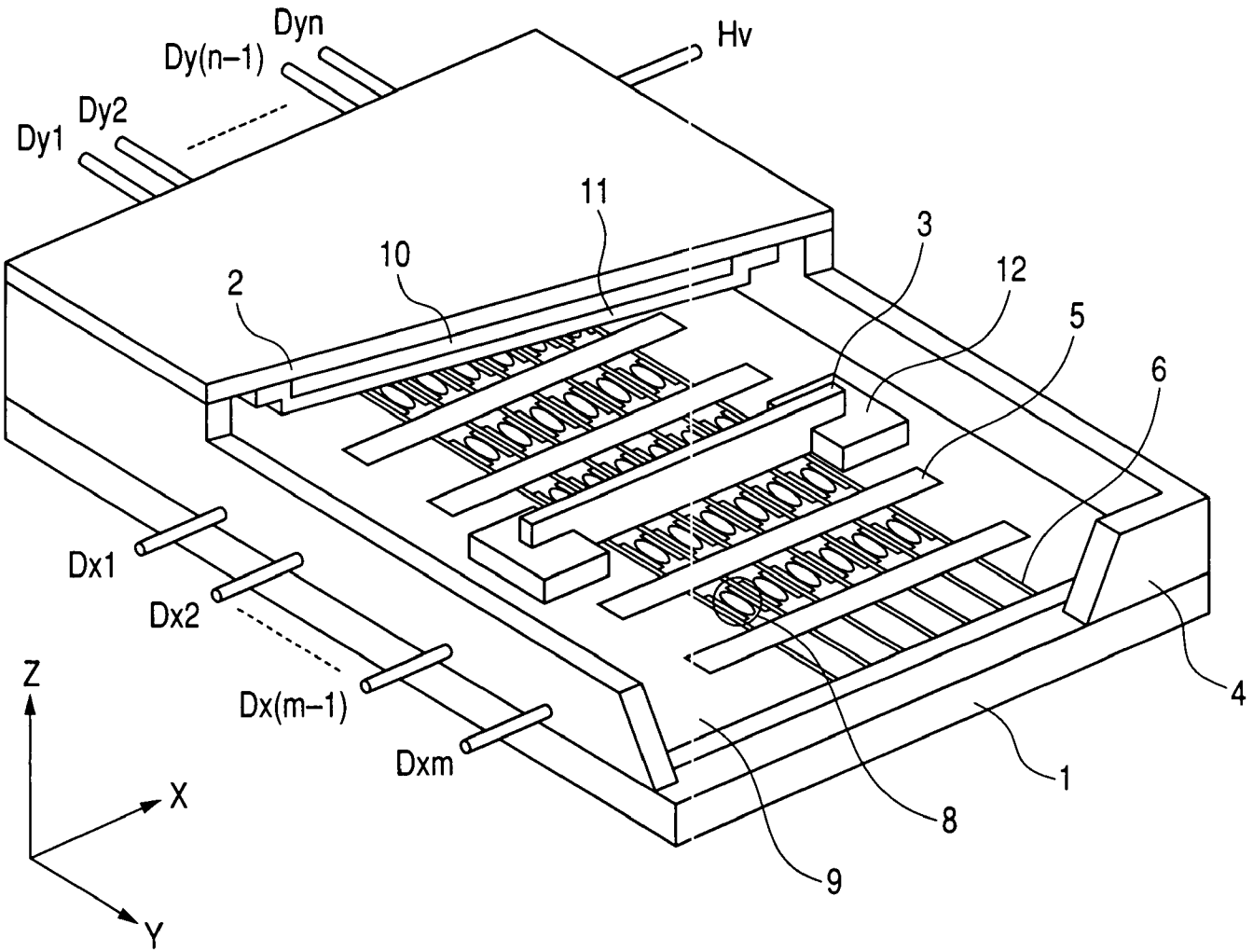
FIG. 1 is a partially broken oblique view of a display panel which is a first embodiment of the present invention.

FIG. 1 is a partially broken oblique view of a display panel, which is a first embodiment of the present invention. Referring to FIG. 1, the display panel of the present invention is comprised of a rear plate 1 which is a first substrate, a face plate 2, which is a second substrate disposed in opposition to the rear plate 1, and an air-tight container comprising a side wall 4 disposed along the peripheral portions of these plates, the interior of which is vacuum atmosphere. Joining portions with the side wall 4 and peripheral portions of the rear plate 1 and the face plate 2 are sealed by frit glass and the like. The rear plate 1 and the face plate 2 are supported by the plate-shaped spacer 3 so as to maintain constant intervals.

On the side of the rear plate 1 to which the face plate 2 faces, there is fixed an electron source substrate 9 in which electron-emitting device (cold cathode device) 8 is formed. The electron-emitting device 8 is a surface conductive type electron-emitting device in which a conductive thin film having an electron-emitting region is connected between a pair of device electrodes, and N×M pieces are disposed. These N×M pieces of the electron-emitting device 8 are wired in a matrix pattern by M pieces of a row directional wiring 5 and N pieces of a column directional wiring 6 so as to constitute a multi electron beam source.

The row directional wiring 5 is positioned upper than the column directional wiring 6, and the row directional wiring 5 and the column directional wiring 6 are insulated by an inter-electrode insulating layer to be described later. For the row directional wiring 5 and the column directional wiring 6, silver paste and various types of conductive materials can be used. These row directional wiring 5 and the column directional wiring 6 can be formed, for example, by coating by a screen printing method or by separating out metal by using an plating method. In addition, the wirings can be formed by using a photolithographic method.

Each of row directional wirings 5 is applied with a scanning signal through each of extraction terminals Dx1 to Dxm. Each of column directional wirings 6 is applied with a modulation signal (image signal) through each of extraction terminals Dy1 to Dyn. The scanning signal is a pulse signal of approx −4V to −10V, and the modulation signal is a pulse signal of approx +4V to +10V.

The undersurface (surface in opposition to the rear plate 1) of the face plate 2 is provided with a phosphorous film 10 excited and emitted by the electron emitted from the electron-emitting device 8 and a metal back (accelerating electrode) 11 comprised of a conductive member.

Since the display panel of the present embodiment is a color display panel, the phosphorous film 10 is coated by phosphor of primary colors of red, green, and blue. The phosphor of each color is, for example, coated in a stripe pattern, and between the phosphors of each color, there is provided a black conductor (black stripe).

The metal back 11 is an electrode for accelerating the electron emitted from the electron-emitting device 8, and is applied with a high voltage through a high voltage terminal Hv.

That is, the metal back 11 is regulated to high potential, comparing to the row directional wiring 5 of the rear plate 1 side.

The spacer 3 is provided along the row directional wiring 5, and both end portions thereof are supported by a block 12 fixed to the electron source substrate 9. One side of the long side of the spacer 3 is abutted against the row directional wiring 5, and the other side is abutted against the metal back 11 of the face plate 2. The spacer 3 is usually provided plural pieces at equal intervals so as to allow the display panel to have resistance to atmosphere.

Figure 2A:
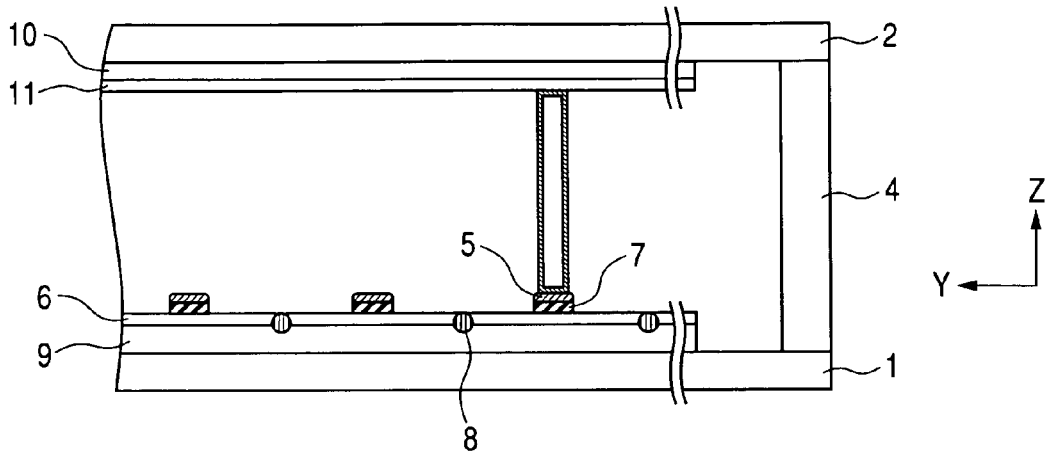
FIG. 2A is a sectional view in case of cutting the display panel shown in FIG. 1 in a direction orthogonal to the longitudinal direction of a spacer.

FIG. 2A is a sectional view in case of cutting the display panel shown in FIG. 1 in a direction orthogonal to the longitudinal direction of a spacer 3. The spacer 3 will be described below in detail with reference to FIGS. 1 and 2A to 2C.

Figure 3A:
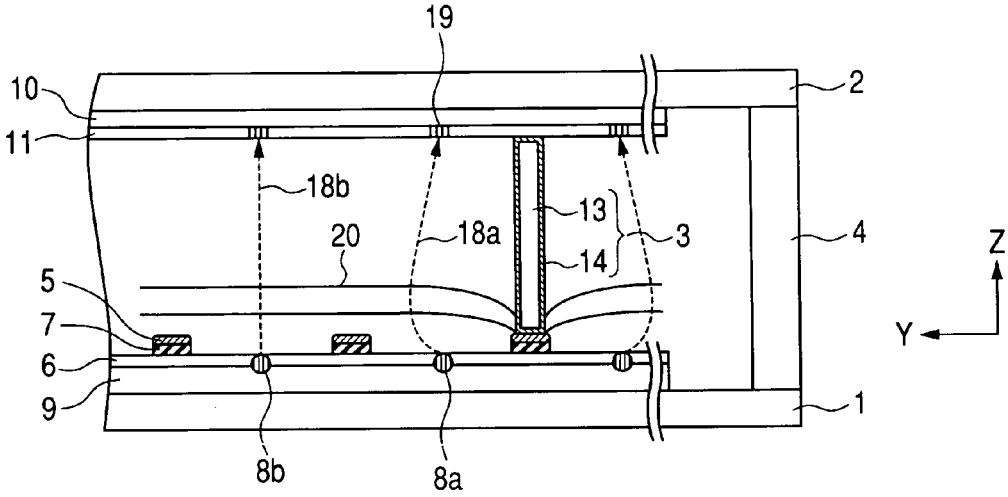
FIG. 3A is a schematic illustration showing the trajectory of the electron beam emitted from an electron-emitting device.

The spacer 3 has insulating properties sufficient enough to endure a high voltage applied between the row directional wiring 5 and the column directional wiring 6 at the rear plate 1 side and the metal back 11 at the face plate 2 side, and moreover, has conductivity to the extent of preventing the charge onto the surface. Specifically, the spacer 3, as shown in FIG. 3A to be described later, is composed of a base substance 13 composed of an insulating material and a high resistance film 14 coating the surface.

As the construction material of the base substance 13, for example, silica glass, glass in which impurity content such as Na and the like are reduced, soda lime glass, ceramics represented by aluminum, and the like can be cited.

In the high resistance film 14, there flows a current in which the accelerating voltage Va applied to the metal back 11 which becomes the high potential side is divided by resistance value of the high resistance film 14, and by this current, the charge onto the spacer 3 surface is prevented. A desirable range of the resistance value of this high resistance film 14 is decided from the charge and consumption power. In view of the charge prevention, the sheet resistance of the high resistance film 14 is below $10^{14}$ Ω/□, and much preferable sheet resistance is below $10^{12}$ Ω/□, and the most preferable sheet resistance is below $10^{11}$ Ω/□. Although the lower limit of the sheet resistance of the high resistance film 14 depends on the shape of the spacer 3 and the voltage applied between spacers 3, to save consumption power, the sheet resistance is preferably not less than $10^5$ Ω/□, and is more preferably not less than $10^7$ Ω/□.

As the construction material of the high resistance film 14, for example, metallic oxide can be used. Among metallic oxides, oxides of chrome, nickel, and copper are preferable. The reason why is because these oxides are relatively small in secondary electron-emitting efficiency, and are hard to be charged even when the electrons emitted from the electron-emitting device 8 hit upon the spacer 3. As other than the metallic oxide, carbon small in secondary electron emitting efficiency can be used as the construction material of the high resistance film 14. Particularly, since amorphous carbon is highly resistant, if this is used, an adequate surface resistance of the spacer 3 will be easy to obtain.

In the present embodiment, with regard to the electron-emitting device 8 adjacent to the spacer, in consideration of the effect of the surface potential of the spacer 3, the device electrode is formed so that the emitted electron beam is incident at a correct position. FIG. 3A is a schematic illustration showing the trajectory of the electron beam emitted from the electron-emitting device 8, and FIG. 3B is a schematic illustration of the device electrode constituting the electron-emitting device 8.

Figure 3B:
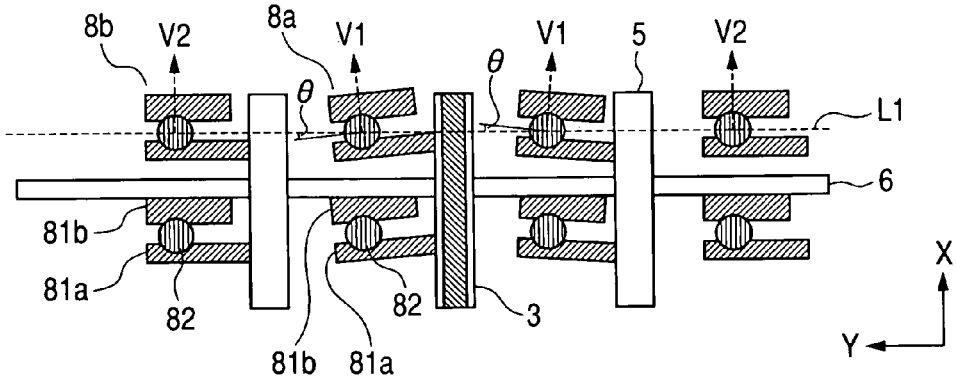
FIG. 3B is a schematic illustration of a device electrode constituting the electron-emitting device shown in FIG. 3A.

As shown in FIG. 3B, the electron-emitting device 8 is comprised of a pair of device electrodes 81*a* and 81*b*, and the conductive thin film having an electron-emitting region 82 connected between these device electrodes 81*a* and 81*b*. The device electrode 81*a* is connected to the row directional wiring 5, and has a minus (negative) potential. The device electrode 81*b* is connected to the column directional wiring 6, and has a plus (positive) potential.

Among the electron-emitting devices 8, the device electrodes 81*a* and 81*b* of the electron-emitting device 8*a* adjacent to the spacer 3 have the inclination to a line L1 parallel with the row directional wiring 6. Specifically, the device electrodes 81*a* and 81*b* are formed so that an angle θ made by the long direction of a gap between the device electrodes 81*a* and 81*b* and the line L1 becomes a predetermined angle. Through such constitution, the trajectory of the electron beam emitted from the electron-emitting device 8 adjacent to the spacer 3 becomes similarly to an electron beam trajectory 18*a* shown by a broken line of FIG. 3A. That is, in the electron-emitting device 8 adjacent to the spacer 3, the electron emitted from the electron-emitting device 82 flies out as if distanced from the spacer 3 immediately after the emission, and after that, in proportion as approaching the face plate 2, it flies out as if approaching the spacer 3, and finally it is incident at a predetermined irradiating position 19.

In the meantime, the device electrodes 81*a* and 81*b* of the electron-emitting device 8*b* at the position distanced from the spacer 3 are formed so that the long direction of the gap between the electrodes becomes parallel with the line L1. The electron beam emitted from the electron-emitting device 8*b* thus constituted draws a trajectory approximately parallel with the spacer 3 similarly to the electron beam trajectory 18*b* shown by the broken line of FIG. 3A, and finally it is incident at a predetermined irradiating position 19.

A relation between the constitution of the device electrode of the electron-emitting device adjacent to the spacer 3 and the trajectory of the electron beam to be emitted, which is the features of the display panel of the present embodiment, will be described below in detail.

(1) A relation between the initial velocity vector and the trajectory of the electron beam:

In the electron-emitting device, as shown in FIG. 3B, the electron is emitted from the minus potential device electrode 81*a* to the plus potential device electrode 81*b* with a certain initial velocity. In the electron-emitting device 8*a* adjacent to the spacer 3, a pair of device electrodes 81*a* and 81*b* are formed so as to have the inclination of an angle θ to the line L parallel with the row directional wiring 6. Hence, the electron is emitted from the electron-emitting device 8*a* by the initial velocity vector V1 having a component (Y directional component) distancing from the spacer 3. Consequently, in the vicinity of the electron-emitting region 82, the electron beam takes a trajectory as if to distance from the spacer 3. An initial velocity vector V2 of the electron emitted from the electron-emitting device 8*b* at the position distanced from the spacer 3 takes a trajectory parallel with the spacer 3 since it does not contain the component distancing from the spacer 3.

Here, a trajectory compensation of the electron beam by the device electrode having the angle θ will be described.

Figure 4A:
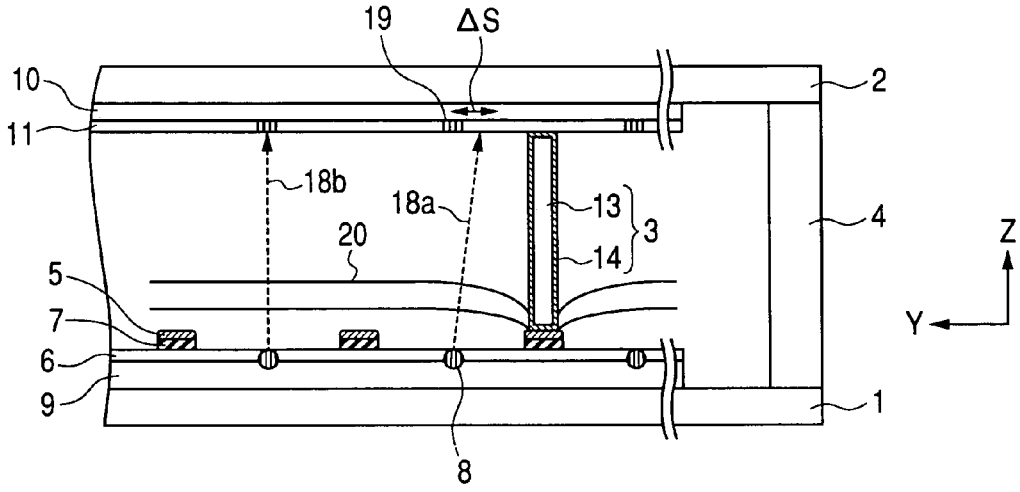
FIG. 4A is a schematic illustration showing the trajectory of the electron beam in case the initial velocity vector of the electrons emitted from all the electron-emitting devices is made equal.
Figure 4B:
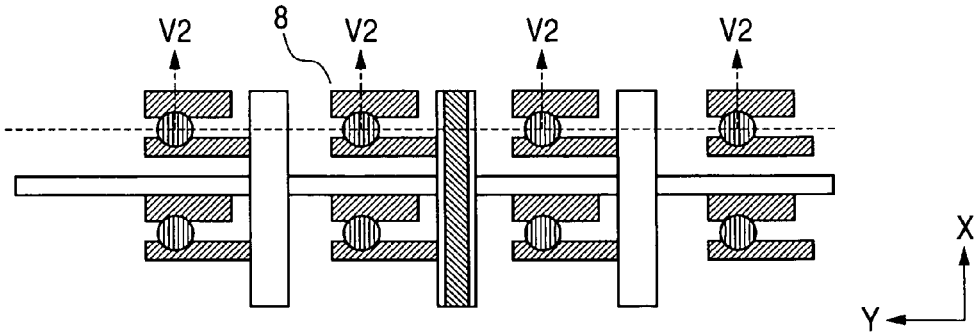
FIG. 4B is a schematic illustration showing the initial velocity vector of the electron emitted from the electron-emitting device shown in FIG. 4A.

As a first state (hereinafter referred to as state A), in case all the electron-emitting devices 8 are constituted such that they have no angle θ, that is, the electron beam trajectory in case the initial velocity vectors of the electrons emitted from all the electron-emitting devices are made equal is shown in FIG. 4A, and the initial velocity vector thereof is shown in FIG. 4B. In this state A, as shown in FIG. 4B, irrespective of the distance from the spacer 3, the initial velocity vectors of the electrons emitted from all the electron-emitting devices 8 are taken as V2. Hence, as shown in FIG. 4A, due to the effect of a potential distribution 20 created by the spacer 3, the final incident position of the electron beam emitted from the electron-emitting device adjacent to the spacer 3 is shifted to the spacer 3 by AS from the predetermined irradiating position 19.

Figure 5A:
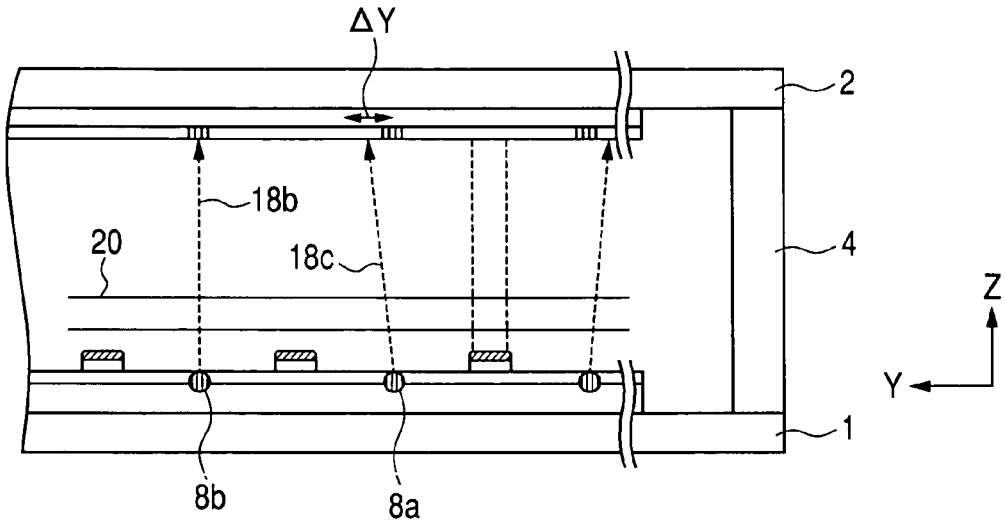
FIG. 5A is a schematic illustration showing the electron beam trajectory in the constitution removing the spacer from the constitution shown in FIG. 3A.
Figure 5B:
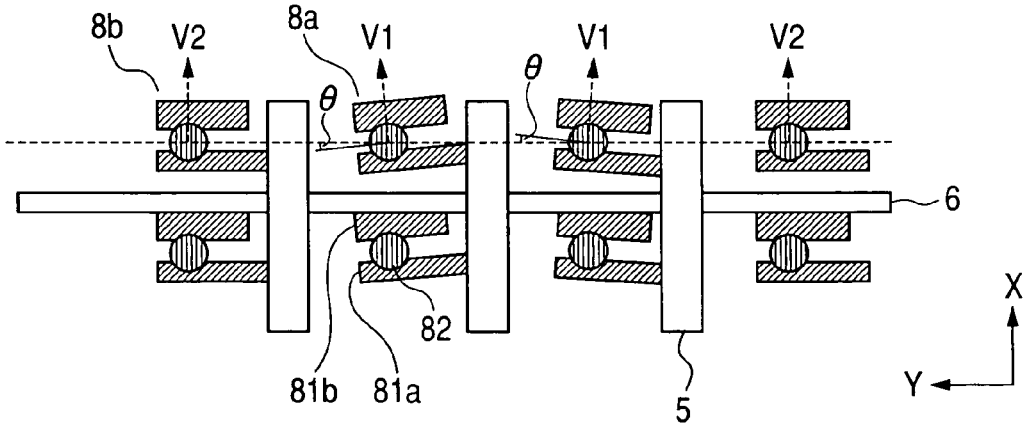
FIG. 5B a schematic illustration showing the initial velocity vector of the electron emitted from the electron-emitting device shown in FIG. 5A.

As a second state (hereinafter referred to as state B), the electron beam trajectory in case the spacers 3 are removed from the constitution (constitution wherein the longitudinal direction of the gap between a pair of device electrodes of some electron-emitting devices is inclined by the angle θ to the row wiring) shown in FIGS. 3A and 3B is shown in FIG. 5A, and the initial velocity vector thereof is shown in FIG. 5B. In this state B, as shown in FIG. 5B, since the device electrodes 81*a* and 81*b* of the electron-emitting device 8*a* are formed so as to have the inclination of the angle θ to the row directional wiring 6, the electron emitted from the electron-emitting device 8*a* is emitted by the initial velocity vector V1 having a Y directional component (component distancing from the spacer 3 shown in FIGS. 3A and 3B). Consequently, the electron beam emitted from the electron-emitting device 8*a*, as shown in FIG. 5A, despite the fact that potential distribution 20 is flat, is shifted by ΔY from the predetermined irradiating position 19 in the final incident position.

Figure 6:
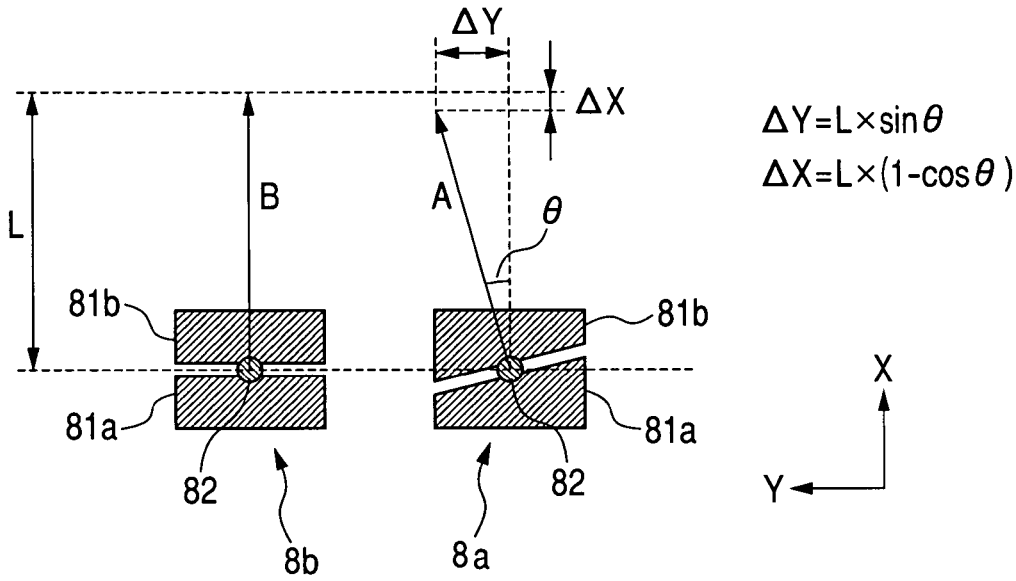
FIG. 6 is a schematic illustration showing an electron incident point in an angle 0.

In FIG. 6 is schematically shown a relation between the angle θ and the incident point of the electron. In FIG. 6, an arrow mark A shows a trajectory of the electron emitted from the electron-emitting device 8*a* (electron-emitting device where the longitudinal direction of the gap between a pair of device electrodes 81*a* and 81*b* inclines to the row wiring by the angle θ) in which the device electrode has an inclination of the angle θ to the row directional wiring 6, and an arrow mark B shows the trajectory of the electron emitted from the electron-emitting device 8*b* in which the long direction of the device electrode gap is parallel with the row directional wiring 6. The start points of the arrow marks A and B are the emitting points of the electron, and the stop points thereof are the incident points of the electron. FIG. 6 is equivalent to the view in which the electron emitting-device formed on the electron substrate 9 of the rear plate 1 is seen through from just above the face plate 2. Reference character L is referred to as a curve-advancing amount, and its value depends on the magnitude of the initial velocity vector. In case the magnitude of the initial velocity vector of each electron-emitting device is equal, the curve-advancing amount L becomes also equal. That is, if the applied voltage between the devices is equal, the curve-advancing amount L will also become equal. Consequently, the lengths of the arrow marks A and B are equal. At this time, the shift ΔY in a Y direction from the desired position of the incident point of the electron is given as follows.

$$\Delta Y = L \times \sin\theta$$

Further, the shift ΔX in an X direction from the desired position of the incident point of the electron is given as follows.

$$\Delta X = L \times (1 - \cos\theta)$$

If θ is sufficiently small, ΔX is sufficiently small for ΔY. For example, in case θ=10°, ΔX/ΔY is below 0.09.

Figure 7:
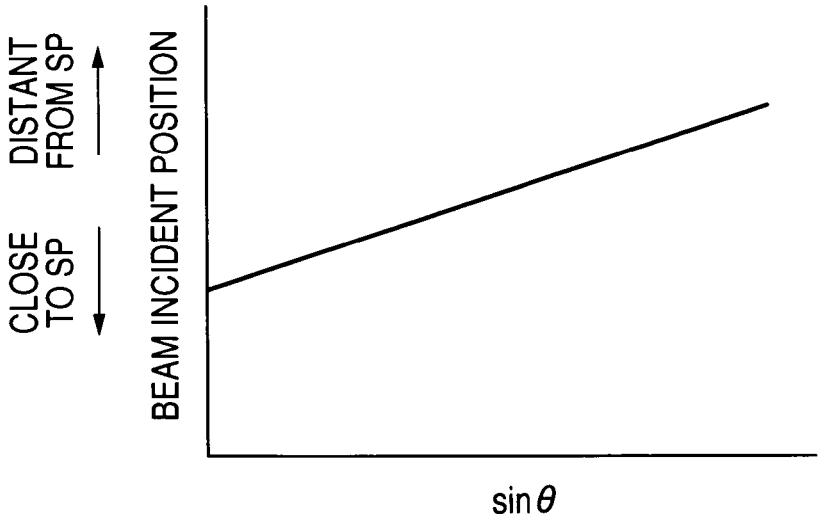
FIG. 7 is a graph showing the relation between the angle 9 and a distance from the spacer of the position at which the electron beam is incident.

The component distancing from the spacer 3 of the initial velocity of the electron is given by the function of θ. In FIG. 7, a relation between the angle θ and the distance from the spacer 3 at the incident position of the electron beam is shown. The axis of ordinate shows the electron beam incident position, and the axis of abscissas shows [sin θ]. As can be seen from FIG. 7, in proportion as θ becomes larger, the electron beam trajectory distances from the spacer 3.

(2) A trajectory of the electron beam in the vicinity of the undersurface of the spacer 3:

On the spacer surface, there is often generated a positive electrostatic charge. As a result, the potential of the spacer surface rises, and as shown in FIG. 3A, a convex equipotential line 20 (convex equipotential line 20 toward the face plate side) is generated above, and the electron beam flies as if to close on the spacer 3. Further, depending on the contact state between the spacer and the wiring, the convex equipotential line is often generated toward the face plate side as described above. This will be described below.

Figure 16A:
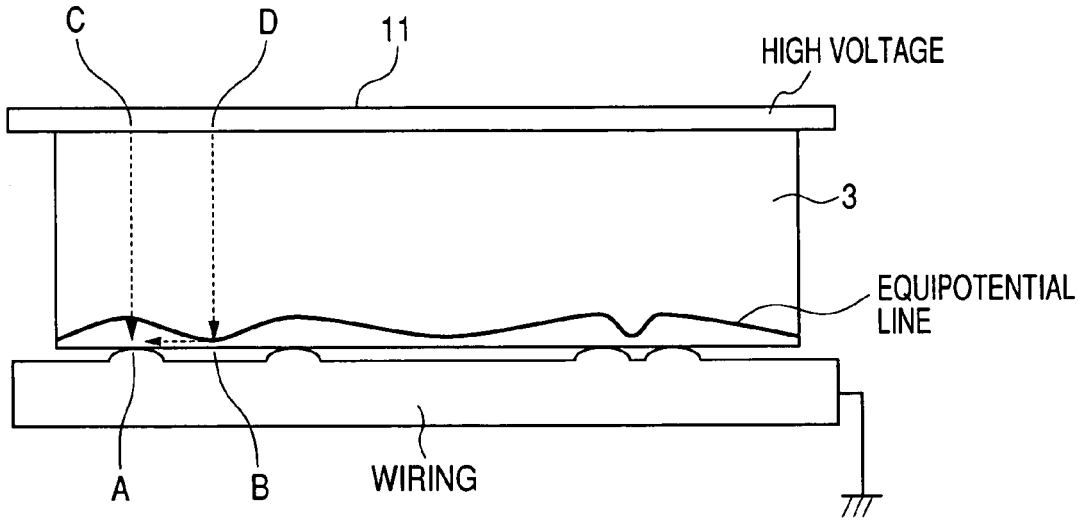
FIG. 16A is a schematic illustration showing a potential distribution of the spacer surface where a high resistance film and a wiring are brought into contact at an unintended portion in the constitution using a plate-shaped spacer coated with a conventional high resistance film.
Figure 16B:
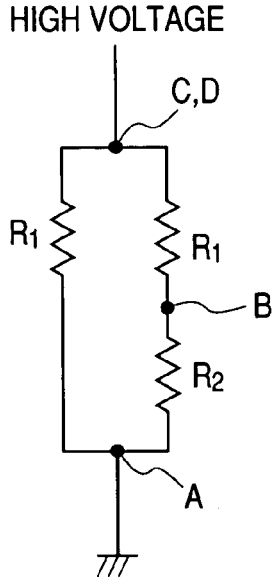
FIG. 16B is an equivalent circuit view having a constitution shown in FIG. 16A.

FIG. 16A is a view showing a potential distribution of the spacer surface in case the high resistance film and the wiring are brought into contact at an unintended portion when the plate-shaped spacer coated with the high resistance film is interposed along the wiring of a first substrate (electron source substrate), and FIG. 16B is an equivalent circuit view of FIG. 16A.

The contact portion between the wiring and the high resistance film of the first substrate side is taken as a point A, and a non-contact portion as a point B. Further, a portion opposed to the point A of the contact portion between the metal back 11 and the high resistance film of the spacer 3 of a second substrate side is taken as a point C, and the portion opposed to the point B as a point D, and a resistor between the point A and the point C is taken as $R_1$. Further, a resistance between the point A and the point B is taken as $R_2$. At the point B, which is the non-contact portion, the potential rises from the point A by voltage drop caused by the resistor $R_2$, which is a resistor between the point B and the point A, which is a contact portion. By this, in the vicinity of the point B, a convex equipotential line is formed toward the face plate side as described above. Further, depending on the shape of the insulating layer interposed between the row wiring and the column wiring, the spacer and the row wiring are often brought into a partial contact. This will be described by using FIG. 2.

Figure 2B:
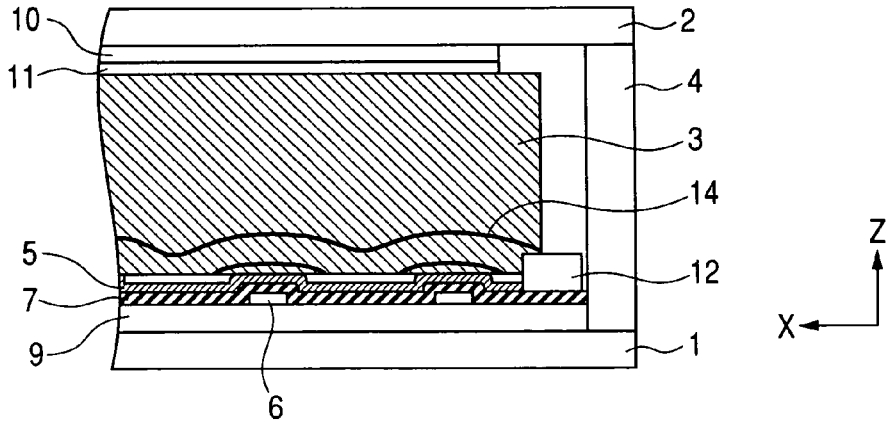
FIG. 2B is a sectional view in case of cutting the display panel shown in FIG. 1 in a direction orthogonal to the longitudinal direction of the spacer.
Figure 2C:
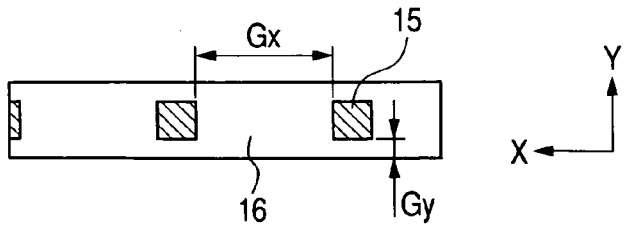
FIG. 2C is an explanatory drawing of a contact portion and a non-contact portion of a high resistance film and a row directional wiring of the spacer in the display panel shown in FIG. 1.

FIG. 2B is a sectional view in case of cutting the display panel shown in FIG. 1 in the longitudinal direction of the spacer 3, and FIG. 2C is an explanatory drawing of a high resistance film 14 of the spacer 3 and a contact portion and a non-contact portion of the row directional wiring 5. A pressure contact state between the spacer 3 and the row directional wiring 5 will be described below in detail with reference to FIG. 1 and FIGS. 2A to 2C.

The spacer 3 is nipped between the rear plate 1 and the face plate 2, and the high resistance film 14 coating the surface thereof is pressure-contacted with the row directional wiring 5 of the rear plate 1 side and the metal back 11 of the face plate 2 side, and at each pressure-contacted portion, an electrical contact is made. As shown in FIG. 2B, the row directional wiring 5 is formed so as to cross the column directional wiring 6. Depending on the shape of the insulating layer 7, the surface of the row directional wiring 5 is put into a state of being protruded to the face plate 2 side by thickness of the column directional wiring 6, comparing to other portions in a crossing portion, and therefore, the high resistance film 14 is pressure-contacted in the protruded portion only of the surface of the row directional wiring 5. Consequently, the high resistance film 14 and the row direction wiring 5, as shown in FIG. 2C, are electrically connected only in the contact portion which is a cross portion 15 between the row directional wiring 5 and the column direction wiring 6, and the portion other than this is a non-contact portion 16, and therefore, no electrical connection is made. The equipotential line 17 in the vicinity of the rear plate 1 in the spacer 3 surface at this time is schematically shown in FIG. 2B by a thick line.

As can be seen from the equipotential line 17 shown in FIG. 2B, since there exists the high resistance film 14 also in the spacer portion corresponding to the non-contact portion 16, the potential in the vicinity of the non-contact portion 16 rises. This is because, as explained in FIGS. 16A to 16C, among the routes of the current flowing from the metal back 11 to the contact portion 15, the resistance value of the current route through the non-contact portion 16 is larger than the resistance value of the current route (for example, the current route from the overhead portion of the contact portion 15) not through the non-contact portion 16, and therefore, the potential rises by the voltage drop due to this increased resistance value. In this case also, as described above, the convex equipotential line is formed at the face plate side.

Further, in this constitution, different from the case of FIGS. 16A to 16C, since there exist the non-contact portions 16 at equal intervals (controlled intervals), there exists also regularity in a relative positional relation with the electron-emitting device. That is, since the column directional lines 6 are formed at equal intervals, the contact portions 15 and the non-contact portions 16 are formed at equal intervals along the row directional wiring 5. The electron-emitting device 8 is formed in the region divided by the row directional wiring 5 and the column directional wiring 6, and all the electron-emitting devices 8 adjacent to the spacers 3 are at the position adjacent to the non-contact portions 16. All the electron beams emitted from the electron-emitting device 8 adjacent to each non-contact portion 16 are equally affected by the surface potential of the spacer 3 in the non-contact portion 16.

Because of such reasons, in the vicinity of the spacer, the convex equipotential line is often formed toward the face plate, and the electron emitted from the electron-emitting device is deflected toward the spacer approaching direction.

Figure 8:
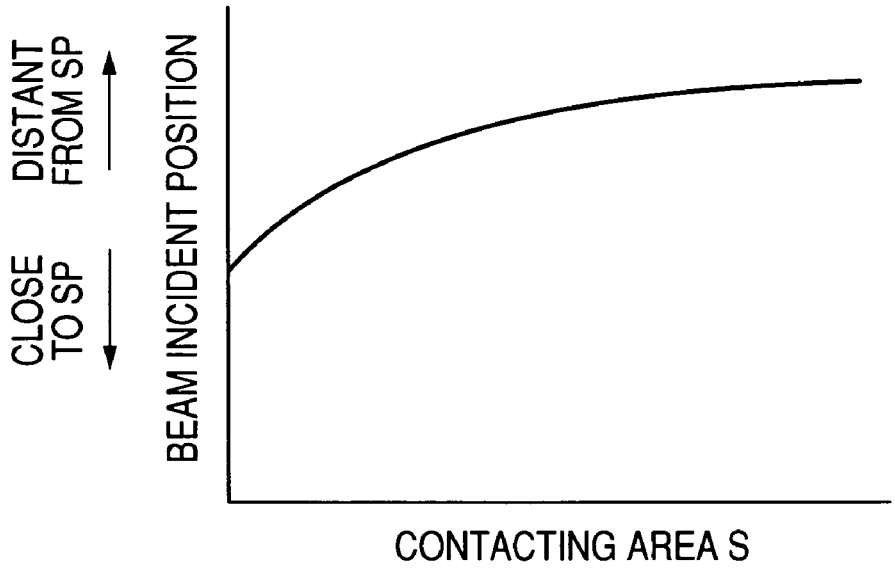
FIG. 8 is a graph showing the relation between a contact area S and a distance from the spacer of the position at which the electron beam is incident.

Further, the component close to the spacer 3 of the electron beam is decided by the contact state between the high resistance film 14 and the row directional wiring 5, specifically by the function of an area (contact area) S of the contact portion 15 shown in FIG. 2C. In FIG. 8 is shown a relation between the contact area (abutting area) S and the distance from the spacer 3 at the position at which the electron beam is incident. The axis of ordinate shows the electron beam incident position, and the axis of abscissas shows the contact area S. As can be seen from FIG. 8, in proportion as the contact area S becomes larger, the position at which the electron beam is incident becomes distant from the spacer 3.

The contact state between the high resistance film 14 and the row directional wiring 5 can be represented by various parameters in addition to the contact area S. For example, as a function such as a peripheral length of the contact portion 15 shown in FIG. 2C, a length Gy of the non-contact portion 16 in a width direction of the row directional wiring 5, a distance Gx between adjacent contact portions 15 in a longitudinal direction of the row direction wiring 5, and the like, the contact state between the high resistance film 14 and the row directional wiring 5 can be represented. In proportion as the peripheral length of the contact portion 15 becomes smaller, and as Gx and Gy becomes larger, the position at which the electron beam is incident becomes closer to the spacer 3.

From the above description, it is clear that the incident position of the electron beam can be controlled by separate and independent parameters having nothing to do with the spacer 3 itself such as the angle θ and the contact state (for example, the contact area S) between the high resistance film 14 and the row directional wiring 5.

Figure 9:
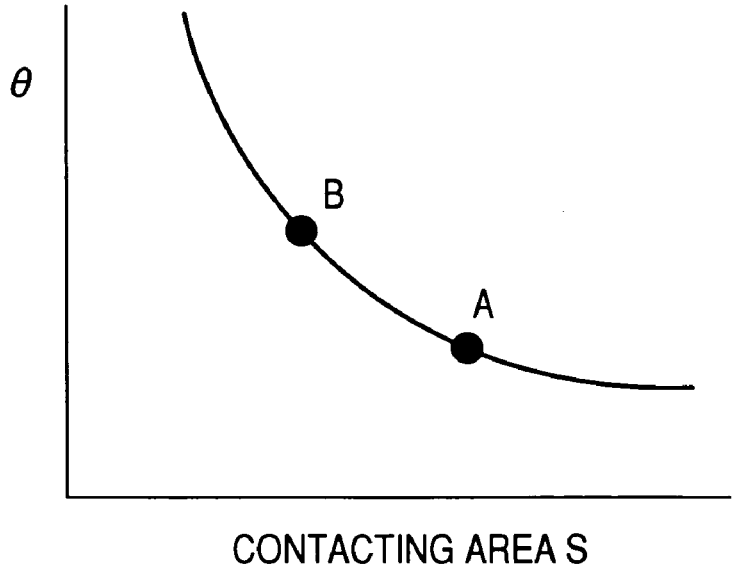
FIG. 9 shows the relation between the angle θ and the contact area S in which the spacer abuts against a row directional wiring.

In FIG. 9 is shown a relation between the angle θ and the area (contact area S) in which the spacer is abutted against by the row directional wiring. The axis of ordinate shows θ and the axis of abscissas shows the contact area S. The example shown in FIG. 9 represents a curved line showing the relation between θ and the contact area S in case the electron beam is incident at the predetermined irradiating position 19 (see FIG. 3A). As can be seen from FIG. 9, the condition (condition having no shift) under which the electron beam is incident at the predetermined irradiating position 19 exists plural. For example, even the condition of the point A or the condition of the point B satisfies the condition under which the electron beams is incident at the predetermined irradiation position 19. The condition of the point B is larger in θ and smaller in the contact area S, comparing to the condition of the point A. In case the design is made under the condition of the point B, for example, the row directional wiring 5 is turned into a convex sectional shape having a curvature. Thus, by turning the surface abutted by the spacer 3 of the row directional wiring 5 not into a flat surface, but into a curved surface, the contact area S can be made small.

In actual designing, for example, from electrostatic field calculation and simulation of the trajectory of the electron beam, the angle θ which is incident at the predetermined irradiating position 19, and the contact area S are decided. In addition, such conditions can be also decided based on actual measurement data.

As described above, according to the display panel of the present embodiment, a desired electron beam incident position can be achieved not by the constitution of the spacer 3 itself, but by controlling the contact state between the high resistance film 14 and the row directional wiring 5 or the angle θ which is the inclination of the device electrode. Hence, the spacer 3 of the same constitution can be used for various image display apparatuses. For example, even in case the change of the specification such as the change of pixel pitches for high definition purpose and an increase of accelerating voltage for high luminance purpose are made, the situation can be dealt with by using the spacer 3 which is the same itself and by performing the change of the contact state between the high resistance film 14 and the row directional wiring 5 or the angle θ which is the inclination of the device electrode. Consequently, productivity can be remarkably enhanced, thereby contributing to drastic cutbacks in cost.

In Table 1 is shown specific values of the area S and the angle θ which satisfy the conditions at the points A and B shown in FIG. 9 with regard to the display panel of the present embodiment as describe above. In this example, the thickness of the spacer 3 is taken as 300 μm, the height of the spacer 3 as 2.4 mm, the intervals between the row directional wirings 5 as 920 μm, the width (length of the traverse direction) of the row directional wiring 5 as 690 μm, the height from the electron-emitting region of the electron-emitting device 8 to the upper surface of the row directional wiring 5 as 75 μm, the applied voltage to the metal back 11 as 15 KV, and the applied voltage between the row directional wiring 5 and the column directional wiring 6 as 14 V. The condition A satisfies the condition at the point A shown in FIG. 9, and θ is [6.1°], and the contact area S is [30625 $\mu m^2$]. The condition B satisfies the condition at the point B shown in FIG. 9, and θ is [9.5°], and the contact area S is [22500 $\mu m^2$]. In any of the conditions A and B, the positional shift (ΔX) of the electron beam in an X direction is not recognized (below detectable limit), and an excellent image can be displayed.

TABLE 1

| Condition | θ (deg) | S ($\mu m^2$) |
|---|---|---|
| A | 6.1 | 30625 |
| B | 9.5 | 22500 |

Figure 10A:
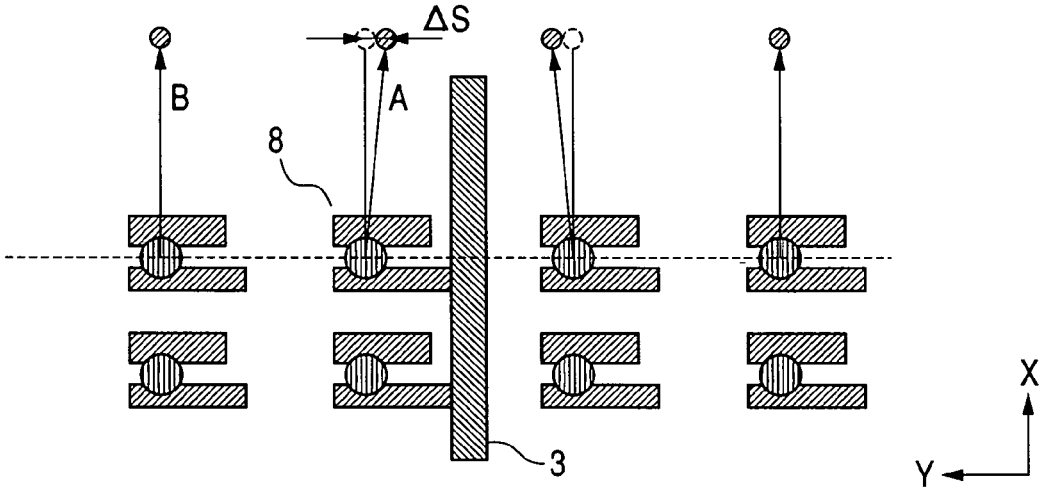
FIG. 10A is a schematic illustration showing the trajectory of the electron beam for explaining the features of the display panel, which is a first embodiment of the present invention, from another viewpoint.
Figure 10B:
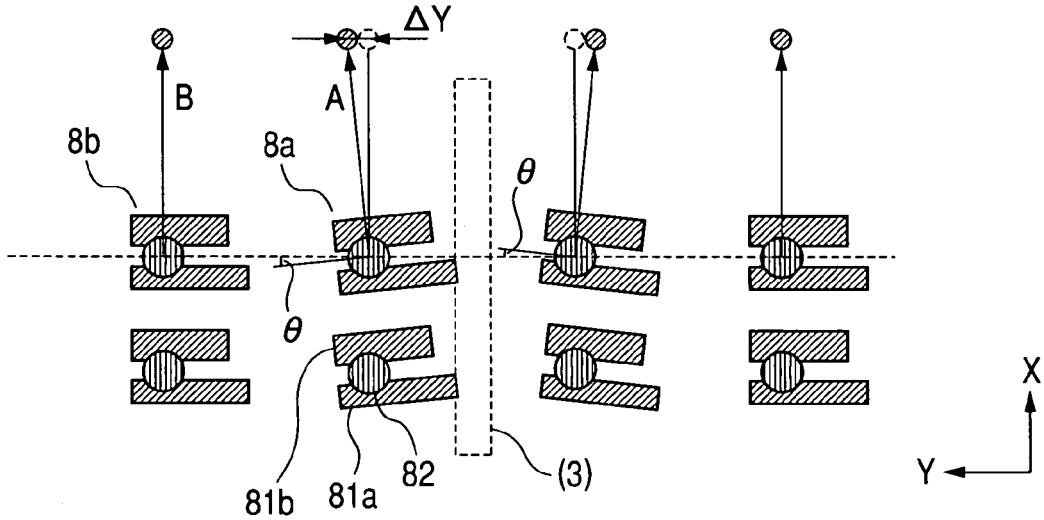
FIG. 10B is a schematic illustration showing the trajectory of the electron beam for explaining the features of the display panel, which is a first embodiment of the present invention, from another viewpoint.

Next, the features of the display panel of the present embodiment will be described from another viewpoint. In FIG. 10A is shown the trajectory of the electron beam in the state A shown in FIGS. 4A and 4B, and in FIG. 10B is shown the trajectory of the electron beam in the state B shown in FIGS. 5A and 5B. In these FIGS. 10A and 10B, and FIGS. 11A to 15B which correspond to other embodiments to be described later, the arrangement of the spacer and the device electrode as well as the electron beam incident position alone are illustrated, and other portions are omitted for the sake of simplicity (for other constitutions, see FIGS. 3A to 5B).

In FIG. 10A, an arrow mark A shows the trajectory of the electron emitted from the electron-emitting device 8 adjacent to the spacer 3, and an arrow mark B shows the trajectory of the electron emitted from the electron-emitting device 8 distant from the spacer 3. The start points of the arrow marks A and B are the emitting points of the electron, and the stop points thereof are the incident points of the electron. The incident point of the electron emitted from the electron-emitting device 8 adjacent to the spacer 3 generates a shift toward the spacer 3 by ΔS. This shift ΔS is the shift brought about by the existence of the spacer 3.

In the meantime, in FIG. 10B, the arrow mark A shows the trajectory of the electron emitted from the electron-emitting device 8*a* comprising the device electrode having the angel θ, and the arrow mark B shows the trajectory of the electron emitted from the electron-emitting device 8*b* having no angle θ. The start points of the arrow marks A and B are the emitting points of the electron, and the stop points thereof are the incident points of the electron. The incident point of the electron emitted from the electron-emitting device 8*a* is shifted by ΔY comparing to the electron emitting-device 8*b* having no angle θ independently from the spacer. This shift ΔY is a shift in a direction reverse to the shift ΔS generated by the existence of the spacer. Hence, by using the constitution shown in FIG. 10B, the shift ΔS generated by the existence of the spacer can be compensated by the shift ΔY to be generated by the angle θ. That is, in the state B shown in FIG. 10B, in case the spacer 3 shown by the broken line is provided, the electron emitted from the electron-emitting device 8*a* adjacent to that spacer 3 is incident at the predetermined irradiating position, thereby realizing an image display having no shift.

According to the above described explanation, though the shift ΔS has been taken as a shift generated according to the abutting state of the spacer, in reality, it is not limited to this, and in case a beam shift relating to the spacer develops due to some reasons, by designing the initial velocity vector of the electron-emitting device, that beam shift can be compensated.

In the second to sixth embodiments to be described below, based on the above described viewpoints, without any mention made of the control and cause of the shift ΔS, the relation between the spacer and the device electrode arrangement, the device applied voltage, and the electron beam incident position for compensating the shift ΔS caused by the spacer will be described by mainly comparing the states A and B.

Second Embodiment

A display panel of a second embodiment of the present invention will be described. The display panel of the present embodiment compensates a shift AS generated in a direction to distance from a spacer, and the basic constitution thereof is the same as that of the first embodiment.

Figure 11A:
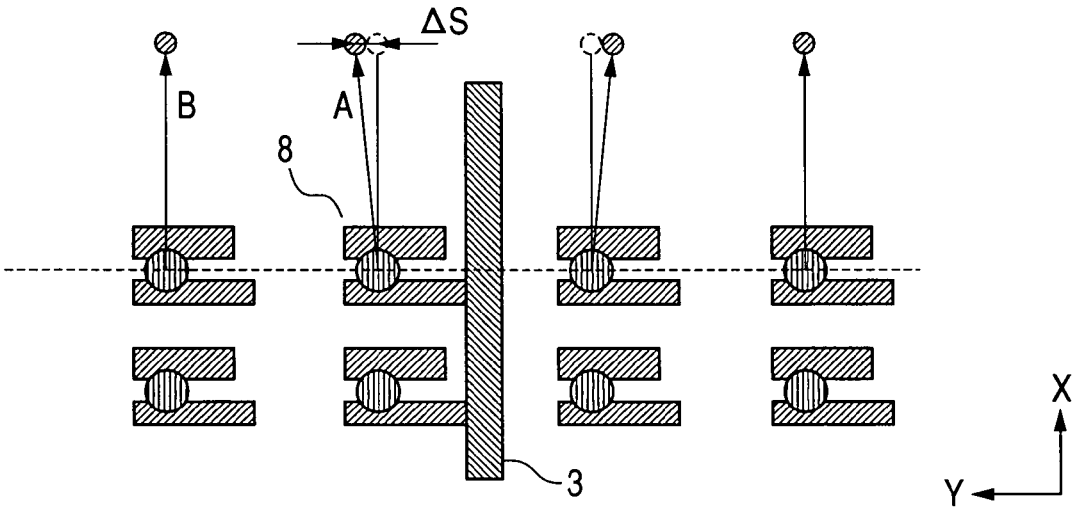
FIG. 11A is a view for explaining the display panel, which is a second embodiment of the present invention, and is a schematic illustration showing the trajectory of the electron beam emitted from the electron-emitting device in which the device electrode has no inclination.
Figure 11B:
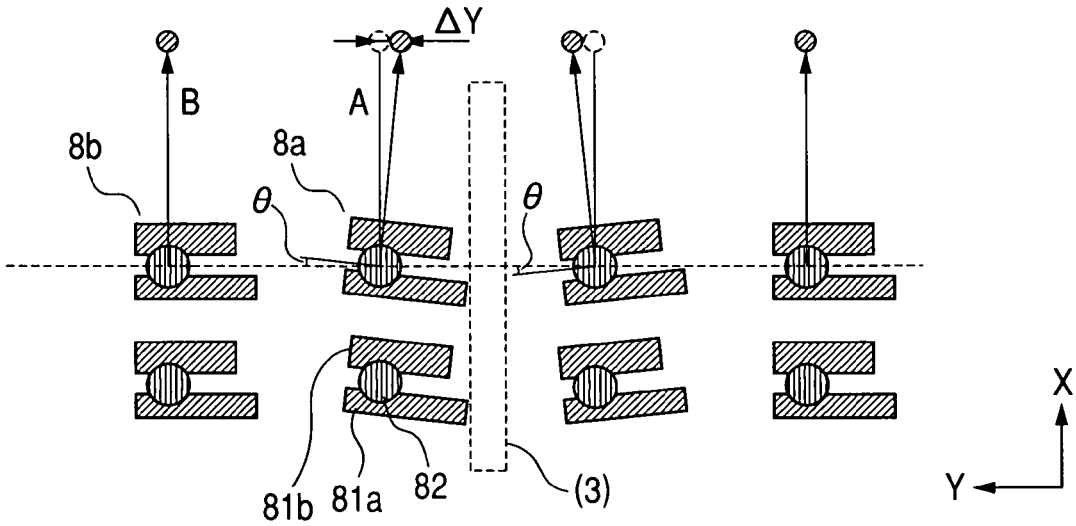
FIG. 11B is a view for explaining the display panel, which is the second embodiment of the present invention, and is a schematic illustration showing the trajectory of the electron beam emitted from the electron-emitting device in which the device electrode has an inclination.

In FIG. 11A is shown the shift ΔS generated in the direction to distance from the spacer (state A: a state in which the shift is generated depending on the spacer), and in FIG. 11B is schematically shown an electron emitting-device in which a shift ΔY is generated in a direction reverse to the shift ΔS (state B). In FIG. 11A, an arrow mark A shows the trajectory of the electron emitted from an electron-emitting device 8 adjacent to a spacer 3, and an arrow mark B shows the trajectory of the electron emitted from an electron-emitting device 8 distant from the spacer 3. The start points of the arrow marks A and B are the emitting points of the electron, and the stop points thereof are the electron incident points. The incident point of the electron emitted from the electron-emitting device 8 adjacent to the spacer 3 generates a shift in a direction to distance from the spacer 3 by ΔS. This shift ΔS is the shift brought about by the existence of the spacer 3. As one example of generating such a shift, a spacer forming a convex equipotential line on a rear plate (electron source substrate) side which is in a direction reverse to the convex equipotential line on a face plate side shown in FIG. 3A such as the spacer and the like having a low resistance film (spacer electrode) on the whole of the end surface of an electron source side of the spacer can be cited.

In the meantime, in FIG. 11B, the arrow mark A shows the trajectory of the electron emitted from an electron-emitting device 8*a* comprising a device electrode having an angle θ, and the arrow mark B shows the trajectory of the electron emitted from an electron-emitting device 8*b* having no angle θ. In this case, an inclination (angle θ) of the device electrode constituting the electron-emitting device 8*a* is an inclination in a direction just opposite to the inclination (angle θ) of the device electrode constituting the electron-emitting device 8*a* shown in FIG. 10B. The start points of the arrow marks A and B are the emitting points of the electron, and the stop points thereof are the incident points of the electron. The incident point of the electron emitted from the electron-emitting device 8*a* is shifted by AY comparing to the electron emitting-device 8*b* having no angle θ independently from the spacer. This shift ΔY is a shift in a direction reverse to the shift ΔS generated by the existence of the spacer. Hence, by using the constitution shown in FIG. 11B, the shift ΔS generated by the existence of the spacer can be compensated by the shift ΔY. That is, in the constitution shown in FIG. 11B, in case the spacer 3 shown by the broken line is provided, the electron emitted from the electron-emitting device 8*a* adjacent to that spacer 3 is incident at the predetermined irradiating position. Thus, according to the display panel of the present embodiment, by setting the emitting direction of the electron emitted from the electron-emitting device according to the distance (degree of the effect by the spacer) from the spacer, the shift of the electron beam caused by the spacer can be adjusted, thereby realizing an image display having no shift.

Third Embodiment

A display panel of a third embodiment of the present invention will be described. In case, among electron-emitting devices adjacent to both sides of spacer, the incident point of the electron emitted from the one electron-emitting device is shifted to the spacer by ΔS1, and the incident point of the electron emitted from the other electron-emitting device is shifted to the spacer by ΔS2 (≠ΔS1), the display panel of the present embodiment compensates both shifts ΔS1 and ΔS2, and the basic constitution thereof is the same as that of the first embodiment.

Figure 12A:
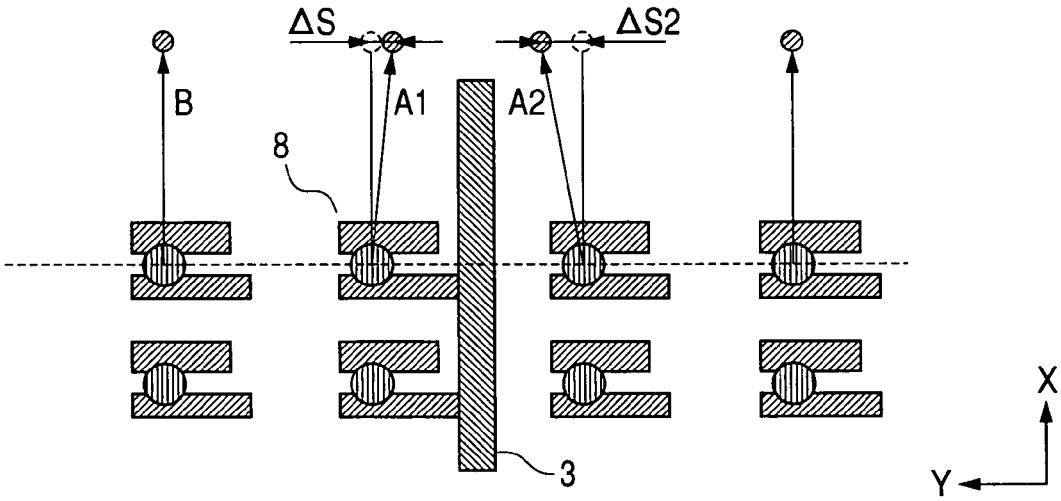
FIG. 12A is a view for explaining the display panel, which is a third embodiment of the present invention, and is a schematic illustration showing the trajectory of the electron beam emitted from the electron-emitting device in which the device electrode has no inclination.
Figure 12B:
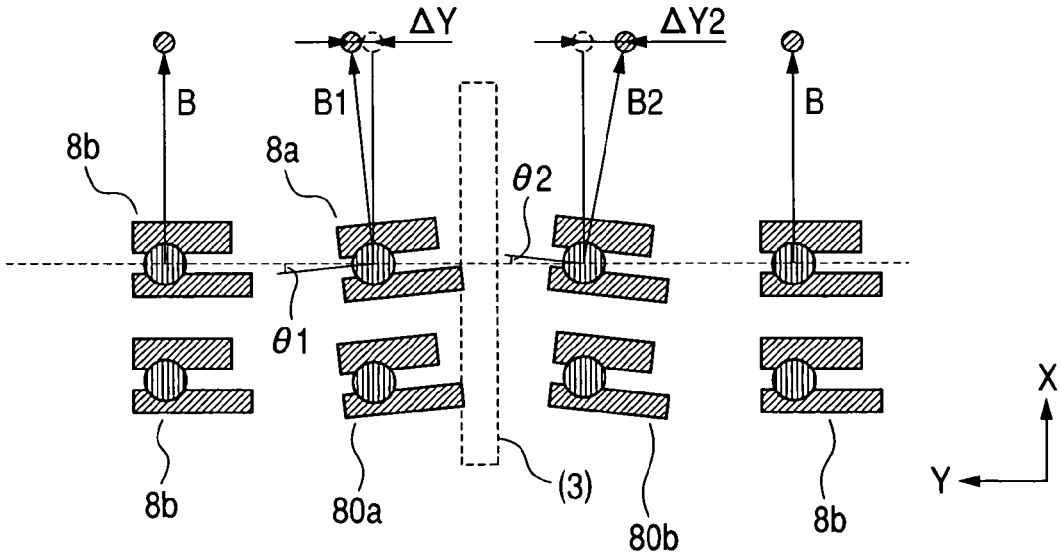
FIG. 12B is a view for explaining the display panel, which is the third embodiment of the present invention, and is a schematic illustration showing the trajectory of the electron beam emitted from the electron-emitting device in which the device electrode has an inclination.

In FIG. 12A is shown shifts ΔS1 and ΔS2 (state A), and in FIG. 12B is schematically shown the electron-emitting devices which generate shifts ΔY1 and ΔY2 in a direction reverse to the shifts ΔS1 and ΔS2 (state B). In FIG. 12A, an arrow mark A1 shows the trajectory of the electron emitted from an electron-emitting device 8 adjacent to the one side of a spacer 3, and an arrow mark A2 shows the trajectory of the electron emitted from an electron-emitting device 8 adjacent to the other side of the spacer 3, and an arrow mark B shows the trajectory of the electron emitted from an electron-emitting device 8 distanced from the spacer 3. The start points of the arrow marks A1, A2, and B are the emitting points of the electron, and the stop points thereof are the electron incident points. The incident point of the electron emitted from the electron-emitting device 8 adjacent to the one side of the spacer 3 generates a shift to the spacer 3 by ΔS1. The incident point of the electron emitted from the electron-emitting device 8 adjacent to the other side of the spacer 3 generates a shift to the spacer 3 by ΔS2 (>ΔS1). Any of these ΔS1 and ΔS2 is the shifts brought about by the existence of the spacer 3.

In the meantime, in FIG. 12B, the arrow mark B1 shows the trajectory of the electron emitted from an electron-emitting device 80*a* having θ1 in the angle made by the longitudinal direction of the device electrode gap and the column direction wiring. The arrow mark B2 shows the trajectory of the electron emitted from an electron-emitting device 80*b* having θ2 (>θ1) in the angle made by the longitudinal direction of a device electrode gap and a column direction wiring. The arrow mark B shows the trajectory of the electron emitted from an electron-emitting device 8*b* having no angle θ. In this case, the inclination (angle θ1) of the electron-emitting device 80*a* and the inclination (angle θ2) of the electron-emitting device 80*b* are the inclination in the same direction as the inclination (angle θ) of the electron-emitting device 8*a* shown in FIG. 10B. The start points of the arrow marks B1, B2, and B are the emitting points of the electron, and the stop points thereof are the incident points of the electron.

The incident point of the electron emitted from the electron-emitting device 80*a* is shifted by ΔY1 comparing to the electron emitting-device 8*b* having no angle θ independently from the spacer. This ΔY1 is a shift in a direction reverse to the shift ΔS1 generated by the existence of the spacer. Further, the incident point of the electron emitted from the electron-emitting device 80*b* is shifted by ΔY2 comparing to the electron emitting-device 8*b* having no angle θ independently from the spacer. This ΔY2 is a shift in a direction reverse to the shift ΔS2 generated by the existence of the spacer. Hence, by using the constitution shown in FIG. 12B, the shifts ΔS1 and ΔS2 generated by the existence of the spacer can be compensated by the shift ΔY1 and ΔY2. That is, in the constitution shown in FIG. 12B, in case the spacer 3 shown by the broken line is provided, the electrons emitted from the electron-emitting device 80*a* and 80*b* adjacent to that spacer 3 are incident at the predetermined irradiating position. Thus, according to the display panel of the present embodiment, even when the shift of the electron beam caused by the spacer is non-symmetrical with a spacer wall surface, by setting the emitting direction of the electron emitted from the electron-emitting device according to the distance (degree of the effect by the spacer) from the spacer, the trajectory of the electron beam can be adjusted, thereby realizing an image display having no shift.

Fourth Embodiment

A display panel of a fourth embodiment of the present invention will be described. In case the incident point of the electron emitted from a first electron-emitting device closest to a spacer is shifted to the spacer by ΔS1, and the incident point of the electron emitted from a second electron-emitting device next to closest to the spacer is shifted to the spacer by ΔS2 (<ΔS1), the display panel of the present embodiment compensates both shifts ΔS1 and ΔS2, and the basic constitution thereof is the same as that of the first embodiment.

Figure 13A:
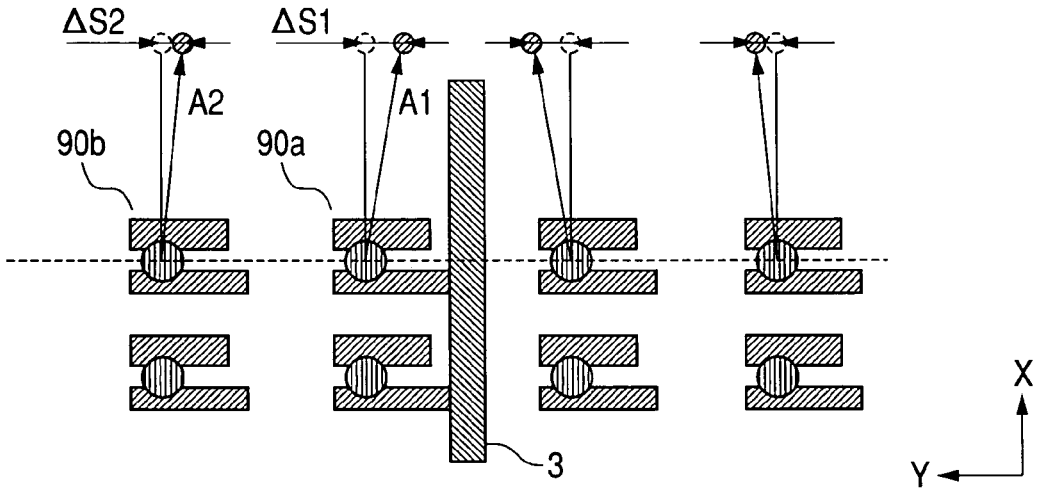
FIG. 13A is a view for explaining the display panel, which is a fourth embodiment of the present invention, and is a schematic illustration showing the trajectory of the electron beam emitted from the electron-emitting device in which the device electrode has no inclination.
Figure 13B:
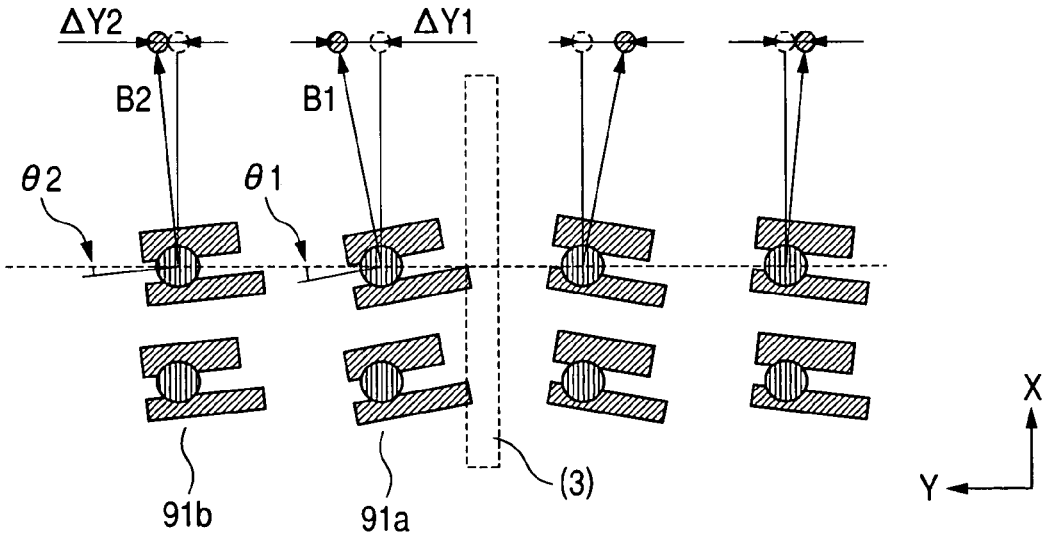
FIG. 13B is a view for explaining the display panel, which is the fourth embodiment of the present invention, and is a schematic illustration showing the trajectory of the electron beam emitted from the electron-emitting device in which the device electrode has an inclination.

In FIG. 13A is shown shifts ΔS1 and ΔS2 (state A), and in FIG. 13B is schematically shown the electron-emitting device which generates shifts ΔY1 and ΔY2 in a direction reverse to the shifts ΔS1 and ΔS2 (state B). In FIG. 13A, an arrow mark A1 shows the trajectory of the electron emitted from an electron-emitting device 90*a* closest to a spacer 3, and an arrow mark A2 shows the trajectory of the electron emitted from an electron-emitting device 90*b* next to closest to the spacer 3. The electron-emitting devices 90*a* and 90*b* are devices in which the longitudinal direction of a device electrode gap is parallel with a column directional wiring. The start points of the arrow marks A1, A2 are the emitting points of the electron, and the stop points thereof are the incident points of the electron. The incident point of the electron emitted from the electron-emitting device 90*a* generates a shift to the spacer 3 by ΔS1. The incident point of the electron emitted from the electron-emitting device 90*b* generates a shift to the spacer by ΔS2. Any of these shifts ΔS1 and ΔS2 is the shifts brought about by the existence of the spacer 3.

In the meantime, in FIG. 13B, the arrow mark B1 shows the trajectory of the electron emitted from an electron-emitting device 91*a* having θ1 in the angle made by the longitudinal direction of a device electrode gap and a column direction wiring. The arrow mark B2 shows the trajectory of the electron emitted from an electron-emitting device 91*b* having θ2 (<θ1) in the angle made by the longitudinal direction of the device electrode gap and the column direction wiring. In this case, the inclination (angle θ1) of the electron-emitting device 91*a* and the inclination (angle θ2) of the electron-emitting device 91*b* are the inclination in the same direction as the inclination (angle θ) of the electron-emitting device 8*a* shown in FIG. 10B. The start points of the arrow marks B1 and B2 are the emitting points of the electron, and the stop points thereof are the incident points of the electron.

The incident point of the electron emitted from the electron-emitting device 91*a* is shifted by ΔY1 independently from the spacer. This ΔY1 is a shift in a direction reverse to the shift ΔS1 generated by the existence of the spacer. Further, the incident point of the electron emitted from the electron-emitting device 91*b* is shifted by ΔY2 independently from the spacer. This ΔY2 is a shift in a direction reverse to the shift ΔS2 generated by the existence of the spacer. Hence, by using the constitution shown in FIG. 13B, the shifts ΔS1 and ΔS2 generated by the existence of the spacer can be compensated by the shifts ΔY1 and ΔY2. That is, in the constitution shown in FIG. 13B, in case the spacer 3 shown by the broken line is provided, the electron emitted from the electron-emitting device 91*a* closest to spacer 3 is incident at the predetermined irradiating position. Similarly, the electron emitted from the electron-emitting device 91*b* next to closest to the spacer is also incident at the predetermined irradiating position. Thus, according to the display panel of the present embodiment, even when the shift of the electron beam caused by the spacer reaches a first electron-emitting device closest to the spacer and a second electron-emitting device next to closest to the spacer, by setting the emitting direction of the electron emitted from the electron-emitting device in stages according to the distance (degree of the effect by the spacer) from the spacer in stages, the trajectory of the electron beam can be adjusted, thereby realizing an image display having no shift.

Thus, according to the present invention, when the spacer causes the effect on a plurality of the devices, most closely neighboring device but also secondary neighboring device in the vicinity of the spacer, all of the devices may be dealt with as "the device adjacent the spacer" in the present invention.

Fifth Embodiment

A display panel of a fifth embodiment of the present invention will be described. In case the incident point of the electron emitted from an electron-emitting device adjacent to a spacer is shifted to the spacer by ΔS, the display panel of the present invention compensates even a displacement amount ΔX in a direction X together with ΔS by changing the magnitude of an initial velocity vector in addition to allowing the device to have an angle θ, and the basic constitution thereof is the same as that of the first embodiment.

Figure 14A:
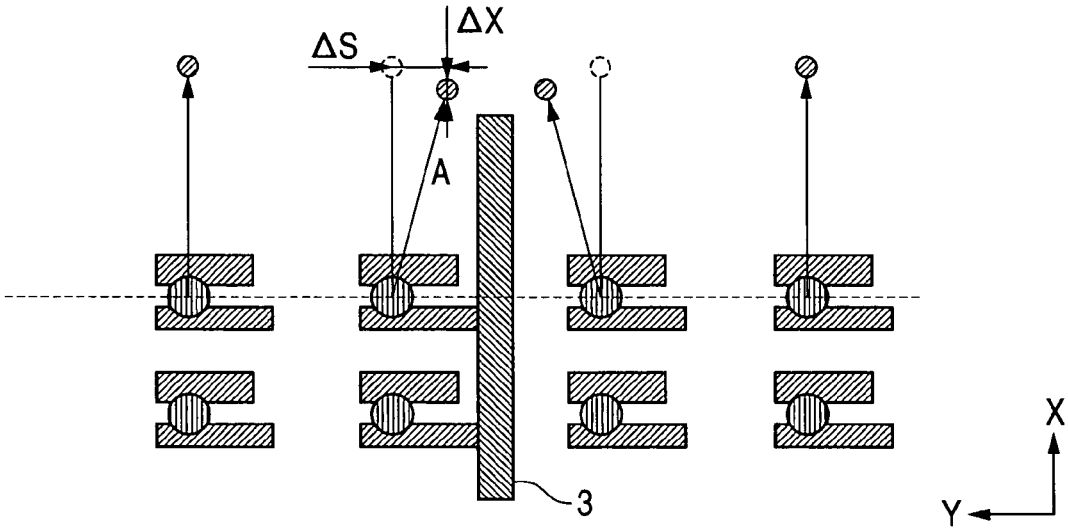
FIG. 14A is a view for explaining the display panel, which is a fifth embodiment of the present invention, and is a schematic illustration showing the trajectory of the electron beam emitted from the electron-emitting device in which the device electrode has no inclination.
Figure 14B:
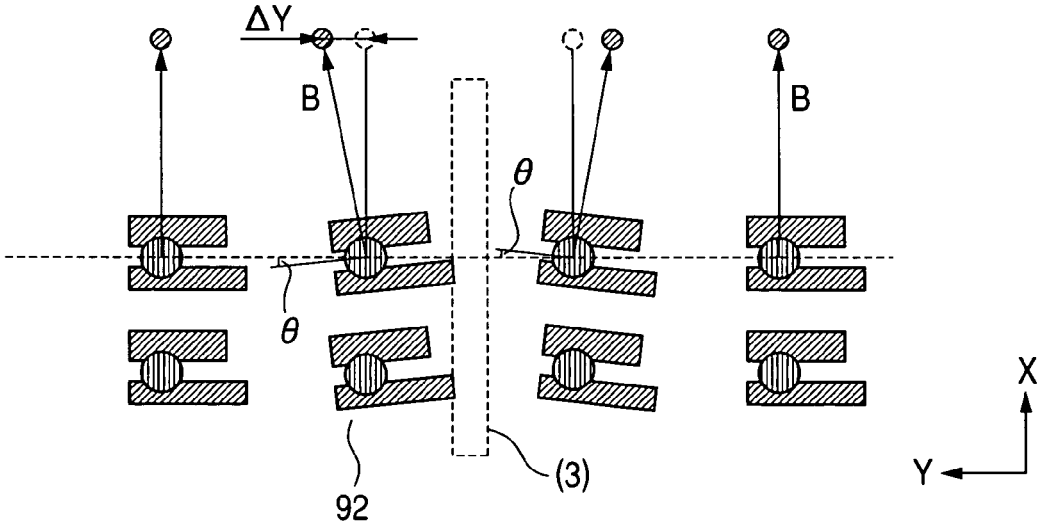
FIG. 14B is a view for explaining the display panel, which is the fifth embodiment of the present invention, and is a schematic illustration showing the trajectory of the electron beam emitted from the electron-emitting device in which the device electrode has an inclination.

In FIG. 14A is shown a shift ΔS (state A), and in FIG. 14B is schematically shown the electron-emitting device in which a shift ΔY is generated in a direction reverse to the shift ΔS (state B). In FIG. 14A, an arrow mark A shows the trajectory of the electron emitted from an electron-emitting device 8 adjacent to a spacer 3. The start point of the arrow mark A is the emitting point of the electron, and the stop point thereof is the incident point of the electron. The incident point of the electron emitted from the electron-emitting device 8 adjacent to the spacer 3 generates a shift to the spacer 3 by ΔS. This ΔS is the shift brought about by the existence of the spacer 3. In the state A, there exists a displacement amount ΔX in an X direction in addition to the shift ΔS.

In the meantime, in FIG. 14B, an arrow mark B shows the trajectory of the electron emitted from an electron-emitting device 92 having θ in the angle made by the longitudinal direction of a device electrode gap and a column directional wiring. In this case, the inclination (angle θ) of the electron-emitting device 92 is an inclination in the same direction as the inclination (angle θ) of the electron-emitting device 8*a* shown in FIG. 10B. The start point of the arrow mark B is the emitting point of the electron, and the stop point thereof is the incident point of the electron. The longer arrow mark B than the arrow mark A shown in FIG. 14A and indicates that the magnitude of the initial velocity vector of the electron emitted from the electron-emitting device 92 is larger than that of the electron-emitting device 8 shown in FIG. 14A.

The incident point of the electron emitted from the electron-emitting device 92 is shifted by ΔY independently from the spacer. This ΔY is a shift in a direction reverse to the shift ΔS generated by the existence of the spacer. Hence, by using the constitution shown in FIG. 14B, the shifts ΔS1 generated by the existence of the spacer can be compensated by the shift ΔY. Further, to increase the magnitude of the initial velocity vector, the voltage applied to the electron-emitting device 92 is made higher than the voltage applied to the electron-emitting device 8 shown in FIG. 14A. Thus, a displacement amount ΔX in an X direction can be compensated. By using the constitution shown in FIG. 14B in this manner, the shifts ΔS and ΔX caused by the existence of the spacer can be compensated. That is, in the constitution shown in FIG. 14B, in case the spacer 3 as shown by the broken line is provided, the electron emitted from the electron-emitting device 92 adjacent to this spacer 3 is incident at the predetermined irradiating position. Thus, according to the display panel of the present embodiment, by setting the emitting direction and emitting velocity of the electron emitted from the electron-emitting device according to the distance (degree of the effect by the spacer) from the spacer, even a displacement amount ΔX in an X direction together with the shift ΔS of the electron beam caused by the spacer can be compensated, thereby realizing an image display having no shift.

In reality, the angle θ and the applied voltage are adequately designed so that the incident point of the electron beam may be compensated at a desired position. The present embodiment is effective for high definition and particularly in case the shift ΔS is large.

Sixth Embodiment

A display panel of a sixth embodiment of the present invention will be described. In case the incident point of the electron emitted from a first electron-emitting device closest to a cylindrical spacer 3 is shifted to the spacer by ΔS1, and the incident point of the electron emitted from a second electron-emitting device next to closest to the spacer 3 is shifted to the spacer by ΔS2 (<ΔS1), the display panel of the present invention compensates both ΔS1 and ΔS2, and the basic constitution thereof is the same as that of the first embodiment.

Figure 15A:
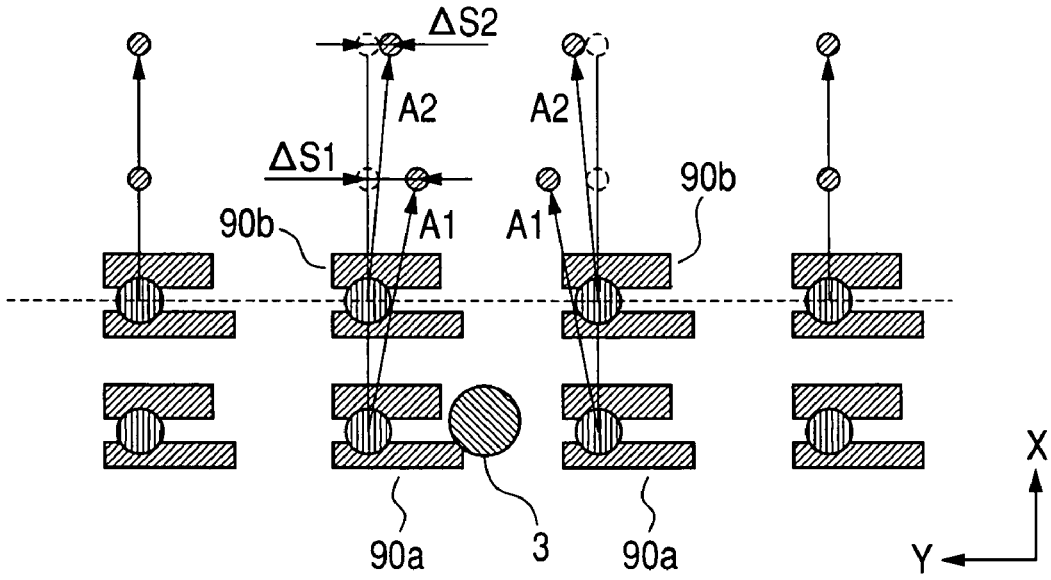
FIG. 15A is a view for explaining the display panel, which is a sixth embodiment of the present invention, and is a schematic illustration showing the trajectory of the electron beam emitted from the electron-emitting device in which the device electrode has no inclination.
Figure 15B:
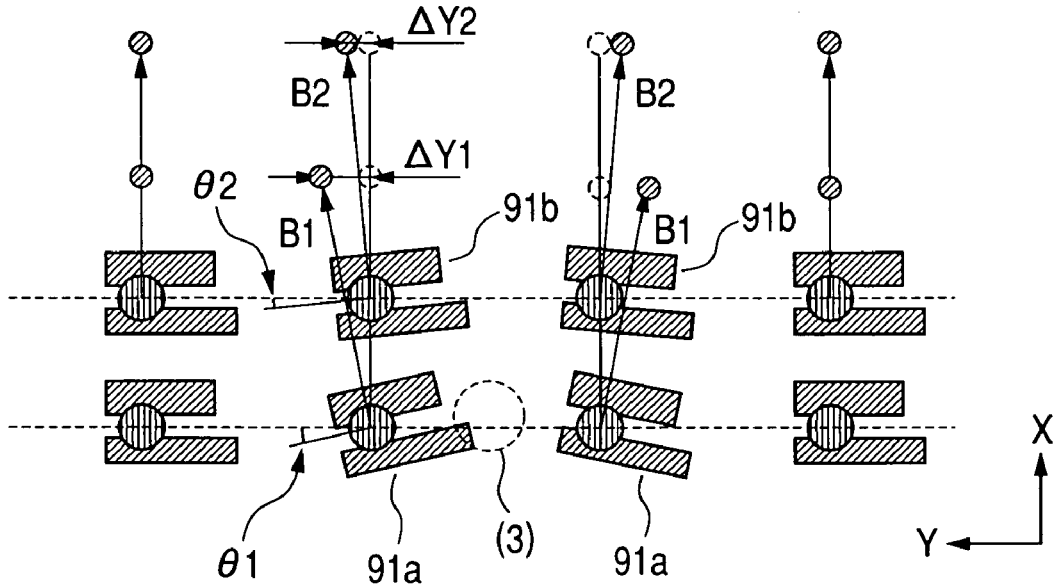
FIG. 15B is a view for explaining the display panel, which is the sixth embodiment of the present invention, and is a schematic illustration showing the trajectory of the electron beam emitted from the electron-emitting device in which the device electrode has an inclination.

In FIG. 15A is shown shifts ΔS1 and ΔS2 (state A), and in FIG. 15B is schematically shown the electron-emitting device which generates shifts ΔY1 and ΔY2 in a direction reverse to the shifts ΔS1 and ΔS2 (state B). In FIG. 15A, an arrow mark A1 shows the trajectory of the electron emitted from an electron-emitting device 90*a* closest to a spacer 3, and an arrow mark A2 shows the trajectory of the electron emitted from an electron-emitting device 90*b* next to closest to the spacer 3.

The electron-emitting devices 90*a* and 90*b* are devices in which the longitudinal direction of a device electrode gap is parallel with a column directional wiring. The start points of the arrow marks A1 and A2 are the emitting points of the electron, and the stop points thereof are the incident points of the electron. The incident point of the electron emitted from the electron-emitting device 90*a* generates a shift to the spacer 3 by ΔS1. The incident point of the electron emitted from the electron-emitting device 90*b* generates a shift to the spacer 3 by ΔS2. Both of these shifts ΔS1 and ΔS2 result from the existence of the spacer 3.

In the meantime, in FIG. 15B, the arrow mark B1 shows the trajectory of the electron emitted from an electron-emitting device 91*a* having θ1 in the angle made by the longitudinal direction of a device electrode gap and a column direction wiring. The arrow mark B2 shows the trajectory of the electron emitted from an electron-emitting device 91*b* having θ2 (<θ1) in the angle made by the longitudinal direction of the device electrode gap and the column direction wiring. In this case, the inclination (angle θ1) of the electron-emitting device 91*a* and the inclination (angle θ2) of the electron-emitting device 91*b* are the inclination in the same direction as the inclination (angle θ) of the electron-emitting device 8*a* shown in FIG. 10B. The start points of the arrow marks B1 and B2 are the emitting points of the electron, and the stop points thereof are the incident points of the electron.

The incident point of the electron emitted from the electron-emitting device 91*a* is shifted by ΔY1 independently from the spacer. This ΔY1 is a shift in a direction reverse to the shift ΔS1 generated by the existence of the spacer. Further, the incident point of the electron emitted from the electron-emitting device 91*b* is shifted by ΔY2 independently from the spacer. This ΔY2 is a shift in a direction reverse to the shift ΔS2 generated by the existence of the spacer. Hence, by using the constitution shown in FIG. 15B, the shifts ΔS1 and ΔS2 generated by the existence of the spacer can be compensated by the shifts ΔY1 and ΔY2. That is, in the constitution shown in FIG. 15B, in case the cylindrical spacer 3 shown by the broken line is provided, the electron emitted from the electron-emitting device 91*a* closest to spacer 3 is incident at the predetermined irradiating position. Similarly, the electron emitted from the electron-emitting device 91*b* next to closest to the spacer 3 also is incident at the predetermined irradiating position. Thus, according to the display panel of the present embodiment, even when the shape of the spacer is cylindrical, by setting the emitting direction of the electron emitted from the electron-emitting device in stages according to the distance (degree of the effect by the spacer) from the spacer, the shift of the electron beam caused by the spacer can be adjusted, thereby realizing an image display having no shift.

Although the examples shown in FIGS. 15A and 15B use the cylindrical spacer 3, even when the spacer of different shape is used, if the angel θ is set so as to compensate the shift ΔS caused by the spacer, the correction of the similar shift of the electron beam can be performed.

Although the shifts ΔS1 and ΔS2 are taken as the shifts to the spacer 3, on the contrary, the shifts may be taken as the shifts distancing from the spacer 3. In this case, the direction of the inclination of the device electrodes of the electron-emitting devices 91*a* and 91*b* becomes a direction in opposite to the direction shown in FIG. 10B.

Further, though two electron-emitting devices 91*a* disposed in opposition to each other with the spacer 3 in between and two electron-emitting devices 91*b* are mutually opposite in the direction of the inclination of each of the device electrodes and the magnitude (angles θ1 and θ2) of the inclination are different, the constitution thereof is not limited to this. Depending on the design, it is conceivable that the angle θ1 becomes the angle θ2.

As described in each of the embodiments, in the image display apparatus of the present invention, by controlling the longitudinal direction of the gap between the pair of device electrodes, the initial velocity vector of the electron emitted from the electron-emitting device, specifically the emitting direction of the electron emitted from the electron-emitting device, preferably the emitting velocity, is set according to the distance (degree of the effect by the spacer) from the spacer. By such a setting, the irregular shift of the electron beam caused by the spacer can be compensated, and as a result, without performing a highly accurate setting of the spacer and a design change, the electron beam can be allowed to be incident at a desired position, thereby making the trajectory of the electron beam according to the design.

Figure 17:
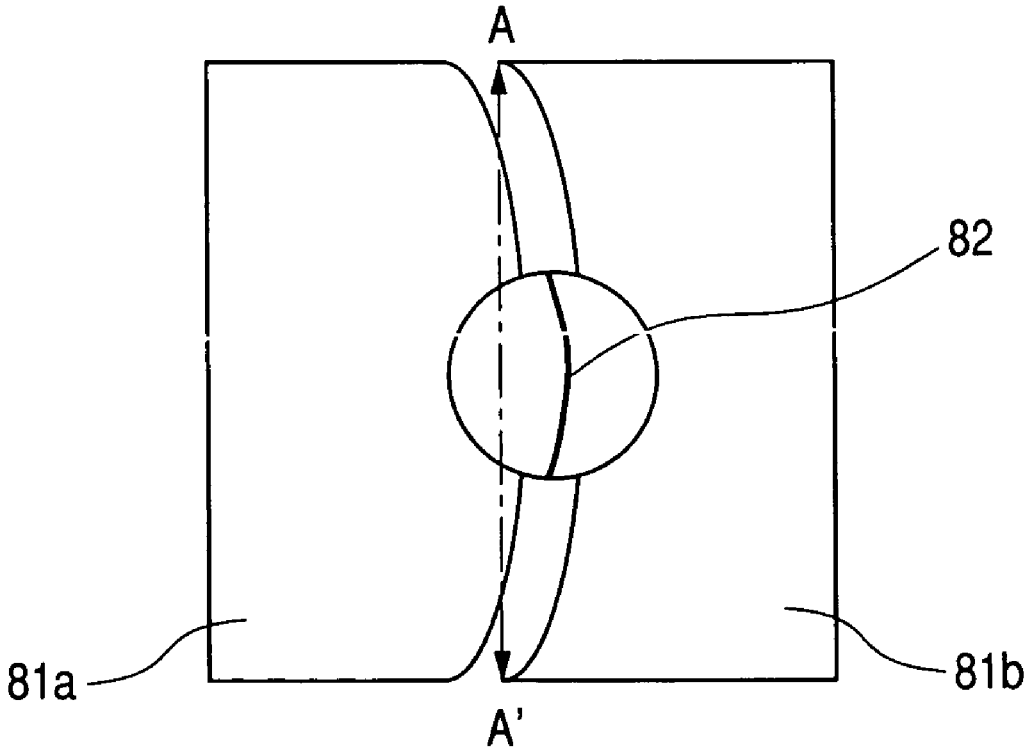
FIG. 17 shows schematically an example of a shape of a pair of device electrodes.

The longitudinal direction of the gap between the pair of electrode according to the present invention is a direction of a straight line connecting both ends of the gap. Accordingly, for example, when the pair of device electrodes are shaped as shown in FIG. 17, the longitudinal direction of the gap between the pair of device electrodes is a direction of extending a line A-A' in FIG. 17. Similar to another drawings, 81*a* and 81*b* denote device electrodes. And, 82 denotes an electron-emitting area.

Further, in the above described embodiments, it is described that all of the electron-emitting devices adjacent closely to the spacer are different from all of the electron-emitting devices disposed not closely to the spacer in the longitudinal directions of the gaps thereof. However, that respect could be indispensable to the present invention, without the limitation by the above respect, the present invention may be used in a configuration wherein only some of the electron-emitting devices adjacent to the spacer has a gap direction different from that of the electron-emitting devices not closely adjacent to the spacer. Such configuration may be used in a display apparatus wherein a potential distribution is uneven locally on a spacer surface, for example, due to an unevenness in distribution of the electrodes thereon The constitution described in each embodiment is just one example, and can be adequately changed in the limit of the invention without departing from the spirit thereof. For example, in the first to fourth embodiments and the sixth embodiment, though the emitting direction alone of the electron emitted from the electron-emitting device is controlled, similarly to the fifth embodiment, the initial velocity in the column direction of the emitted election may be controlled in addition to the control of the emitting direction. Specifically, the initial velocity in the column direction of the electron emitted from the electron-emitting device (electron-emitting device subjected to the effect of the spacer) adjacent to the spacer and the initial velocity in the column direction of the electron emitted from other electron-emitting device may be set to be different. In this manner, the shift ΔS in the Y direction (column direction) and the shift ΔX in the X direction (row direction) can be adjusted together. Particularly, in case the inclination (angle θ) of the device electrode becomes large, since the shift ΔX becomes large, to obtain much excellent image display, the control of the initial velocity becomes important.

According to the present invention, without performing a highly accurate setting of the spacer and a design change, the irregular shift of the electron beam caused by the spacer can be compensated, and therefore, in comparison to the conventional apparatus, the image display apparatus of high image quality can be provided at a low cost.

Further, parameters such as the emitting direction and emitting velocity of the electron emitted from the electron-emitting device according to the present invention can be relatively easily found by, for example, the electrostatic field calculation and the simple electron beam simulation decided by the shape of the panel and a simple electronic beam simulation. In the present invention, by controlling independent parameters independently from the spacer itself, the design of the electronic beam trajectory can be made, and therefore, there is a merit in that the degree of freedom of the design is increased in comparison to the conventional design.

Further, according to the present invention, by controlling independent parameters independently from the spacer itself, the design of the electron beam trajectory can be made, and therefore, the spacer of the same constitution can deal with various image display apparatus modes, and for example, even on the occasion of the specification change of the apparatus modes such as changing pixel pitches for high definition purpose and increasing the accelerating voltage for high luminance purpose, a slight design change of the device electrode shape or drive method will do sufficiently. Thus, in the present invention, since there is also the merit of being able to deal with plural products by the same spacer member, productivity can be remarkably enhanced, thereby contributing to drastic cutbacks in cost.

This application claims priority from Japanese Patent Application No. 2004-163003 filed Jun. 1, 2004, which is hereby incorporated by reference herein.

What is claimed is:

1. An image display apparatus, comprising an electron source having a plurality of electron-emitting devices comprising a pair of device electrodes disposed in opposition to each other with a gap in between and an electron-emitting region positioned between the pair of device eletrodes;

an electrode positioned in opposition to said electron source; and a spacer being positioned between said electron source and said electrode, and positioned adjacent to at least some electron-emitting devices among said plurality of electron-emitting devices, wherein said electron source has plural row wirings and plural column wirings, and each of said plural electron-emitting devices has one of said pair of device electrodes connected to one of said plural row wirings and a further one of said pair of device electrodes connected to one of plural column wirings, and said spacer is positioned on at least one of said row wirings, wherein the longitudinal direction of the gap between the pair of device electrodes of at least one electron-emitting device adjacent to said spacer has an inclination to the longitudinal direction of at least one column wiring, and wherein the inclination of the at least one electron-emitting device is made larger as a distance between the spacer and the at least one electron-emitting device adjacent to the spacer is made smaller.

2. The image display apparatus according to claim 1, wherein said spacer is plate-shaped.

3. An image display apparatus, comprising an electron source having a plurality of first and second electron-emitting devices each comprising a pair of device electrodes disposed in opposition to each other with a gap in between and an electron-emitting region positioned between the pair of device electrodes;

an electrode positioned in opposition to said electron source; and a plate shaped spacer being positioned between said electron source and said electrode, and positioned closer to the second electron-emitting device, rather than to the first electron-emitting device, wherein an inclination of a longitudinal direction of the gap between the pair of device electrodes of said first electron-emitting device, to a direction perpendicular to a longitudinal direction of the plate shaped spacer is a first inclination, an inclination of the longitudinal direction of the gap between the pair of device electrodes of said second electron-emitting device closer to the plate shaped spacer, to the direction perpendicular to the longitudinal direction of the plate shaped spacer is a second inclination, and the second inclination is larger than the first inclination.

4. The image display apparatus according to claim 3, wherein said electron source has plural row wirings and plural column wirings, and the first and second electron-emitting devices have one of said pair of device electrodes connected to one of said plural row wirings and another of said pair of device electrodes connected to one of plural column wirings, and said spacer is positioned on at least one row wiring.

5. The image display apparatus according to claim 4, wherein said second electron-emitting device adjacent to said plate shaped spacer is electrically connected to the wiring on which said spacer is located.

6. The image display apparatus according to claim 4, wherein the longitudinal direction of at least one column wiring is parallel to the direction perpendicular to longitudinal direction of the plate shaped spacer.

7. The image display apparatus according to claim 3, wherein the inclination of the longitudinal direction of the gap of the second electron-emitting device adjacent to the plate shaped spacer to the direction perpendicular to the longitudinal direction of the plate shaped spacer is made larger as a distance between the spacer and the electron-emitting device adjacent to the spacer is smaller.

* * * * *